US011849865B2

(12) United States Patent
Feld et al.

(10) Patent No.: US 11,849,865 B2
(45) **Date of Patent: *Dec. 26, 2023**

(54) SYSTEM FOR A PRESENTATION, SALES OR EXHIBITION STAND AND/OR FOR STORE FITTING, AS WELL AS CURRENT-CARRYING WALL MEMBER IN SUCH A SYSTEM

(71) Applicant: Magnwall GmbH, Weinstadt (DE)

(72) Inventors: Klaus-Dieter Feld, Weinstadt (DE); Roman Stakhivskyi, Amsterdam (NL)

(73) Assignee: Magnwall GmbH, Weinstadt (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/490,825

(22) Filed: Sep. 30, 2021

(65) Prior Publication Data

US 2022/0015541 A1 Jan. 20, 2022

Related U.S. Application Data

(63) Continuation of application No. PCT/EP2020/059330, filed on Apr. 2, 2020.

(30) Foreign Application Priority Data

Apr. 3, 2019 (DE) ..... 10 2019 108 726.0

(51) Int. Cl.
*A47F 11/00* (2006.01)

(52) U.S. Cl.
CPC ..... *A47F 11/00* (2013.01); *A47B 2220/0091* (2013.01)

(58) Field of Classification Search
CPC ..... A47B 2220/0091; A47F 11/00
See application file for complete search history.

(56) References Cited

U.S. PATENT DOCUMENTS 3,522,474 A 8/1970 Piel
3,918,224 A * 11/1975 Sundequist ..... E04B 1/4107 174/491

(Continued)

FOREIGN PATENT DOCUMENTS

DE 9017421 U1 4/1991
DE 102011005735 A1 8/2012

(Continued)

OTHER PUBLICATIONS

International Preliminary Report on Patentability for International Application No. PCT/EP2020/059330, dated Oct. 14, 2021.

(Continued)

*Primary Examiner* — Matthew W Ing
(74) *Attorney, Agent, or Firm* — Jason H. Vick; Sheridan Ross, PC

(57) ABSTRACT

A system including a current-carrying wall member and a current collector. The wall member has a carrier plate, and has first polarity electrical conductor tracks and second polarity electrical conductor tracks. The first and second tracks are arranged alternately, and the first and second tracks are arranged on the front side of the carrier plate. The current collector has a plurality contact needles and is attached to the wall member where at least one of the needles contacts one of the first tracks and at least one other of the needles contacts one of the second tracks. The wall member has a first electrical terminal contact and a second electrical terminal contact, the first contact is electrically coupled to the first tracks, the second contact is electrically coupled to the second tracks, and the first contact and the second contact are on the back side of the carrier plate.

24 Claims, 17 Drawing Sheets

(56) References Cited

U.S. PATENT DOCUMENTS

| | | | | |
|---|---|---|---|---|
| 4,689,726 | A * | 8/1987 | Kretzschmar | F21S 4/20 362/127 |
| 4,973,796 | A * | 11/1990 | Dougherty | H02G 3/286 174/495 |
| 5,425,648 | A * | 6/1995 | Farham | H01R 25/16 439/116 |
| 5,915,824 | A * | 6/1999 | Straat | F21V 33/0012 362/127 |
| 6,042,244 | A * | 3/2000 | Witkoski | A47F 11/10 362/394 |
| 6,231,205 | B1 * | 5/2001 | Slesinger | A47B 97/00 362/225 |
| 6,652,293 | B2 | 11/2003 | Fuchs et al. | |
| 10,373,793 | B2 | 8/2019 | Kawaguchi et al. | |
| 10,897,114 | B2 | 1/2021 | Bombara et al. | |
| 2001/0036070 | A1 * | 11/2001 | Compagnucci | A47B 77/00 362/225 |
| 2004/0228122 | A1 | 11/2004 | Slesinger et al. | |
| 2021/0093101 | A1 | 4/2021 | Feld et al. | |
| 2022/0079353 | A1 | 3/2022 | Feld | |

FOREIGN PATENT DOCUMENTS

| | | | |
|---|---|---|---|
| DE | 102011075460 | A1 | 8/2012 |
| DE | 102013011329 | A1 | 1/2015 |
| DE | 102018115659 | B4 | 1/2020 |
| EP | 0116505 | B1 | 5/1988 |
| FR | 2613883 | A1 | 10/1988 |
| WO | WO 2009/101559 | A1 | 8/2009 |
| WO | WO 2014/118528 | A1 | 8/2014 |
| WO | WO 2016/170295 | A1 | 10/2016 |

OTHER PUBLICATIONS

International Search Report for International Application No. PCT/EP2020/059330, dated May 28, 2020.
Written Opinion for International Application No. PCT/EP2020/059330, dated May 28, 2020.
International Search Report for International Application No. PCT/EP2019/064997, dated Jul. 8, 2019.
Written Opinion for International Application No. PCT/EP2019/064997, dated Jul. 8, 2019.
International Preliminary Report on Patentability for International Application No. PCT/EP2019/064997, dated Jan. 7, 2021.
International Search Report for International Application No. PCT/EP2020/059333, dated May 28, 2020.
Written Opinion for International Application No. PCT/EP2020/059333, dated May 28, 2020.
International Preliminary Report on Patentability for International Application No. PCT/EP2020/059333, dated Oct. 14, 2021.
U.S. Appl. No. 17/122,037, filed Dec. 15, 2020.
U.S. Appl. No. 17/491,714, filed Oct. 1, 2021.
Office Action for U.S. Appl. No. 17/122,037, dated Sep. 18, 2023.
Office Action (Restriction Requirement) for U.S. Appl. No. 17/122,037, dated Jun. 20, 2023.

* cited by examiner

Fig. 6A
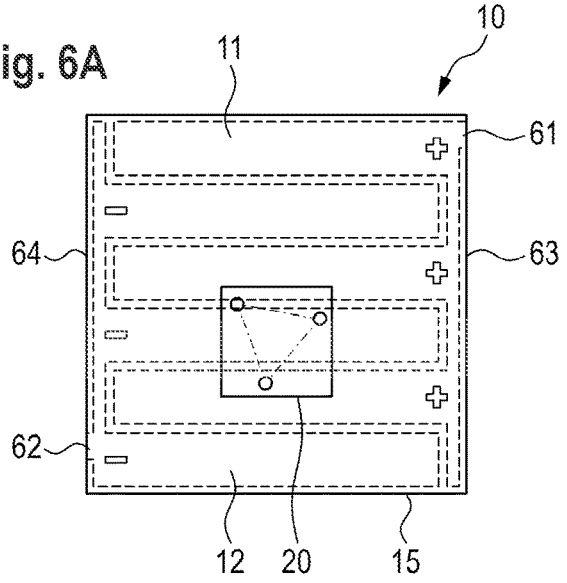
Fig. 6B
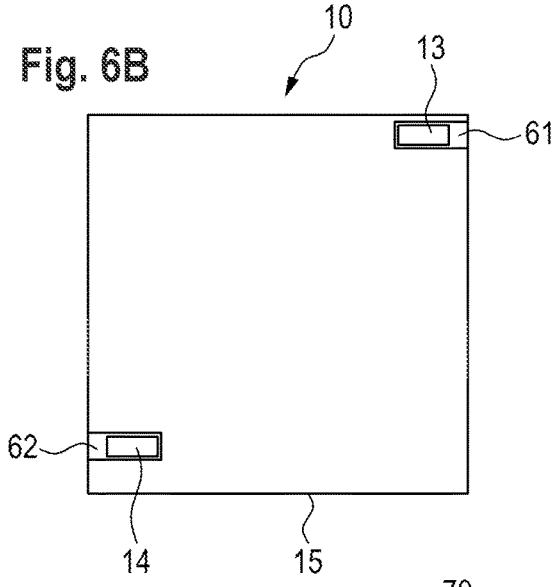
Fig. 6C
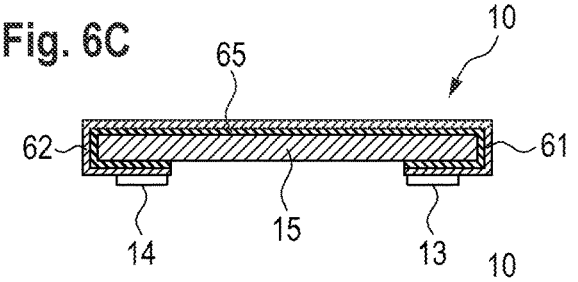
Fig. 6D
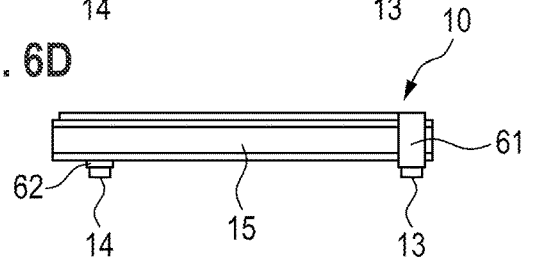
Fig. 6E
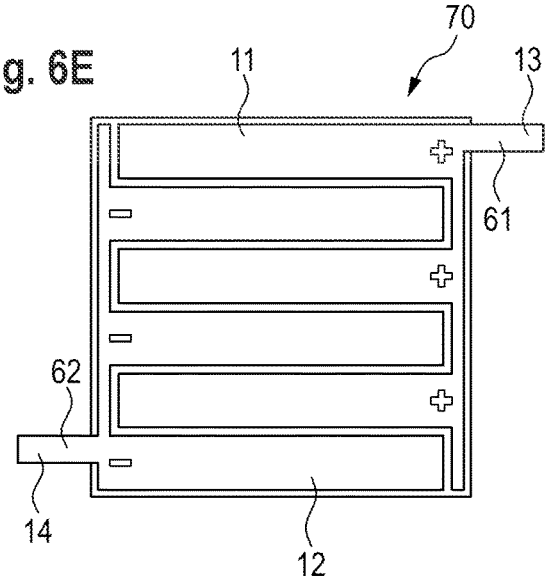
Fig. 6

Fig. 7A
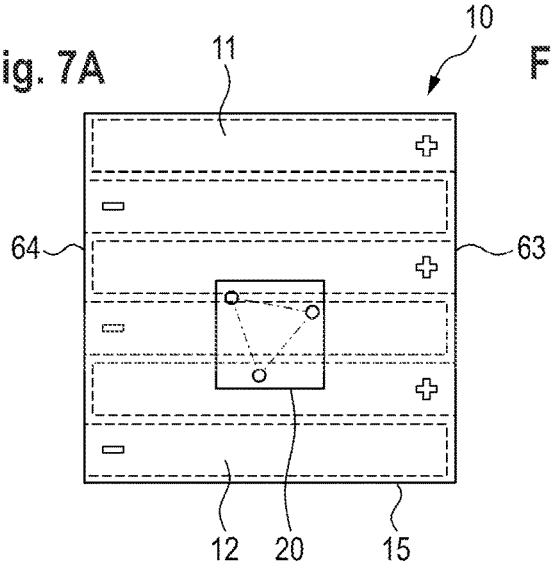
Fig. 7B
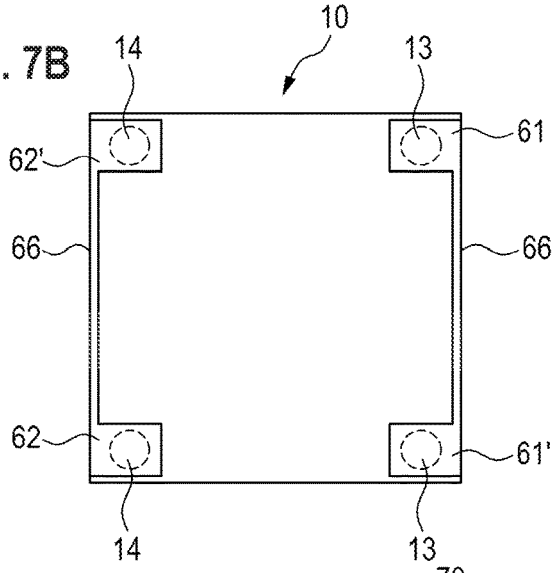
Fig. 7C
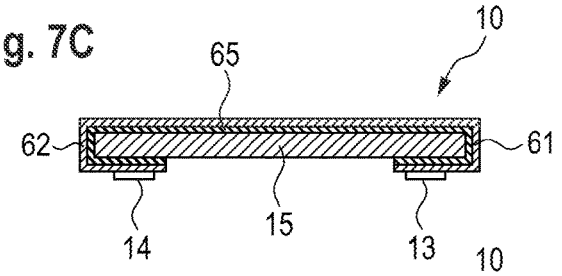
Fig. 7D
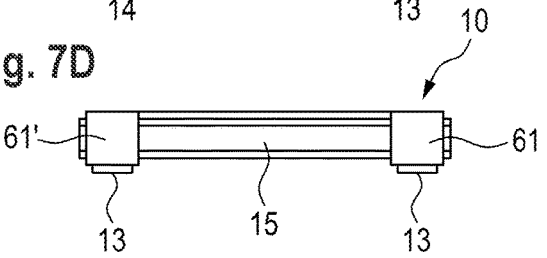
Fig. 7E
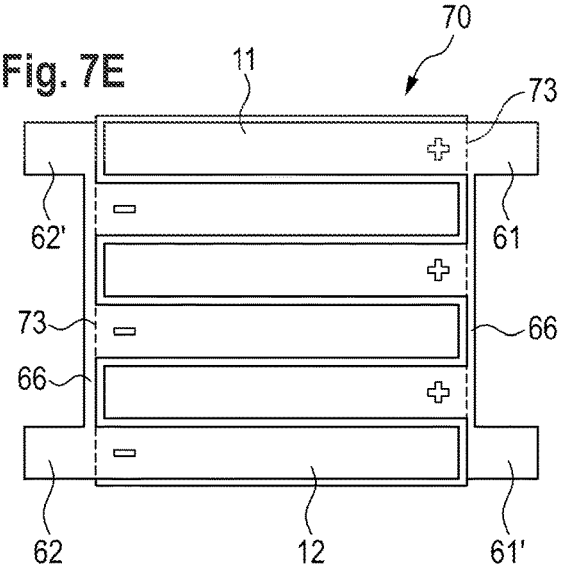
Fig. 7

Fig. 8A
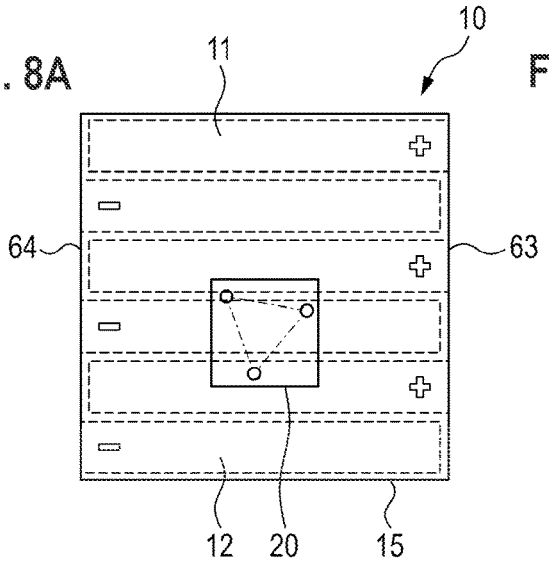
Fig. 8B
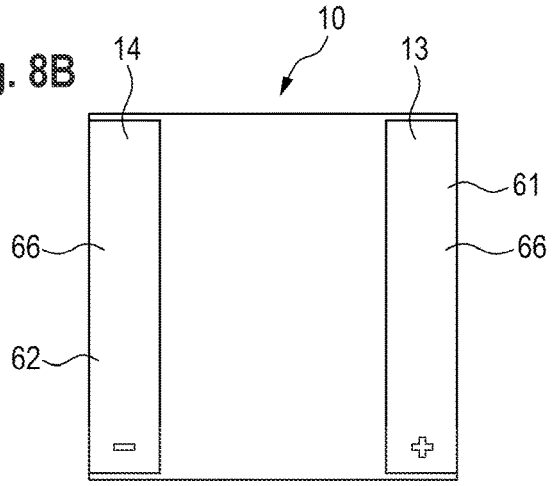
Fig. 8C
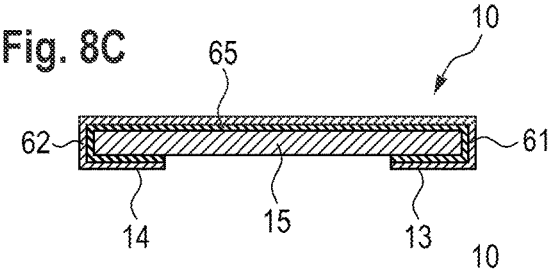
Fig. 8D
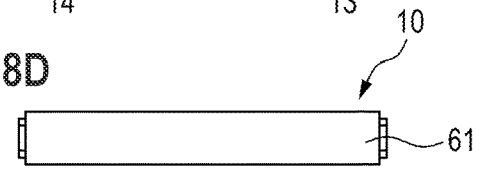
Fig. 8E
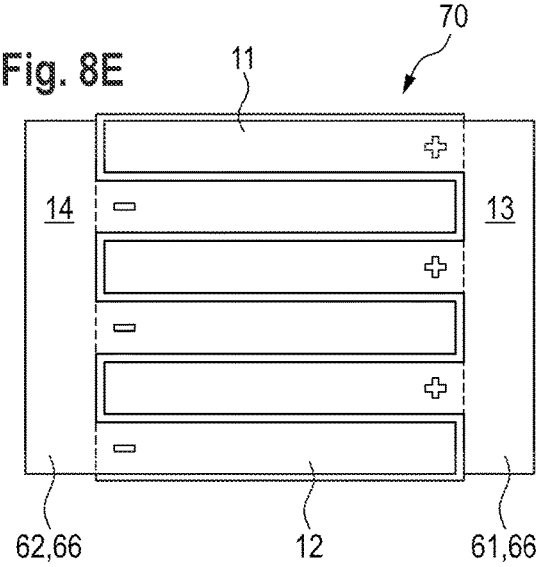
Fig. 8

Fig. 9A
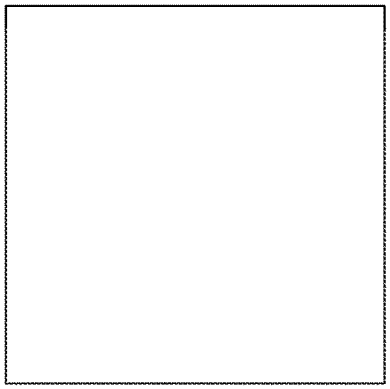
Fig. 9B
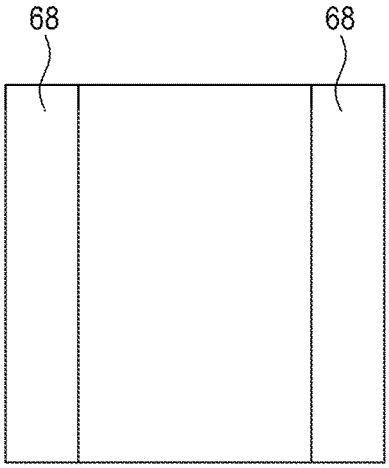
Fig. 9C
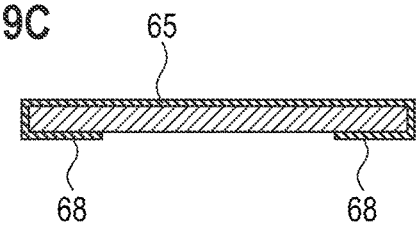
Fig. 9D
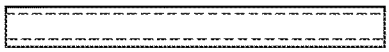
Fig. 9E
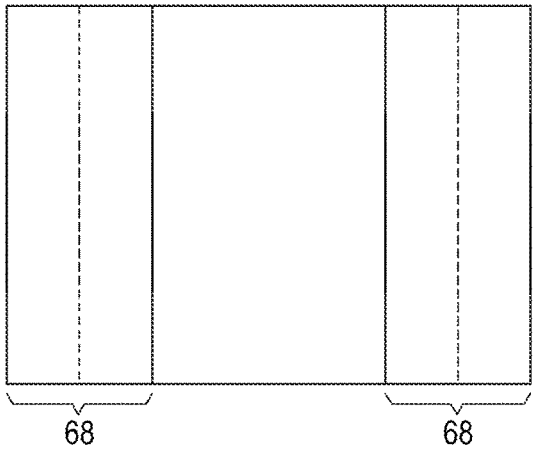
Fig. 9

Fig. 25A
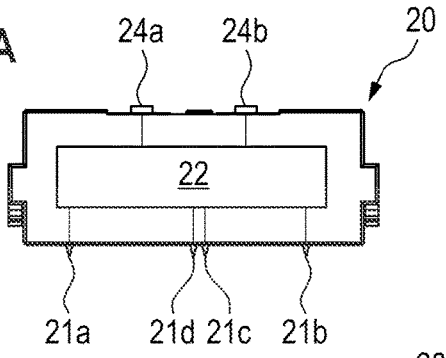
Fig. 25C
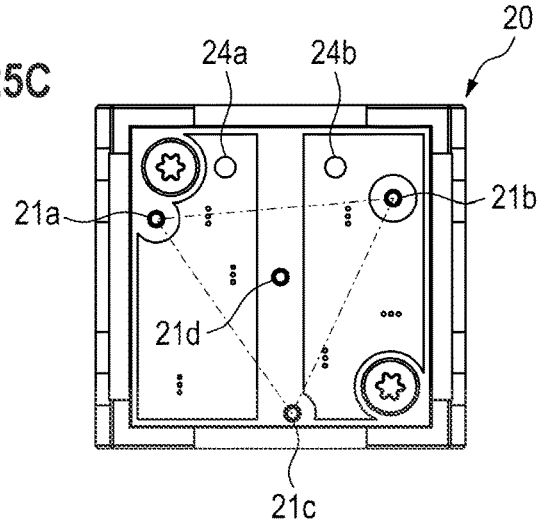
Fig. 25B
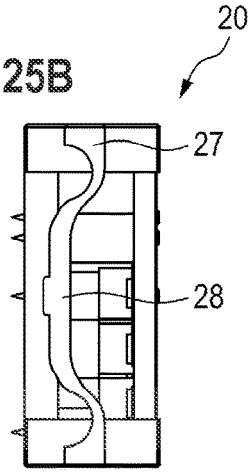
Fig. 25
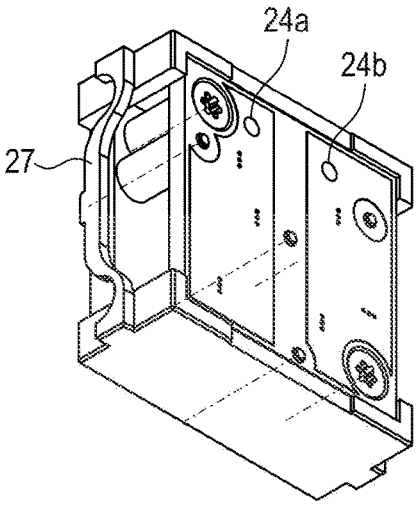
Fig. 26
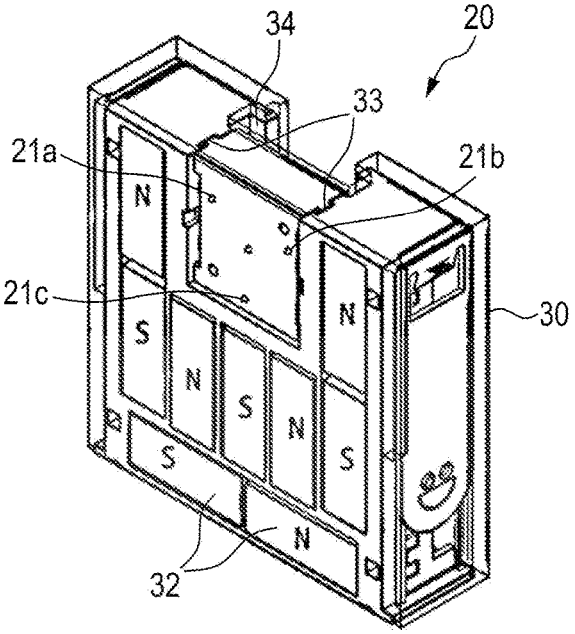
Fig. 27

SYSTEM FOR A PRESENTATION, SALES OR EXHIBITION STAND AND/OR FOR STORE FITTING, AS WELL AS CURRENT-CARRYING WALL MEMBER IN SUCH A SYSTEM

CROSS-REFERENCE TO RELATED APPLICATIONS

This is a continuation application of co-pending international patent application PCT/EP2020/059330, filed Apr. 2, 2020 and designating the United States, which was published in German as WO 2020/201395 A1, and claims priority to German patent application DE 10 2019 108 726.0, filed Apr. 3, 2019, each of which are incorporated herein by reference in their entireties.

BACKGROUND OF THE INVENTION

Field of the Invention

The present invention relates to a system or presentation system, in particular for a presentation, sales or exhibition stand and/or for store fitting, a current-carrying wall member as well as a current collector for an electrical device. The proposed presentation system may also be used in museums or in the field of smart home.

Related Prior Art

A presentation or exhibition stand is the first point of contact for a new customer and therefore particularly important as a figurehead for the company presenting itself. For this reason, the visual impression and also the options for different and in particular flexible presentations are increasingly important. As a special eye-catcher on wall, floor or ceiling members of presentation, exhibition or sales stands, but also in shop-fitting, special electrical devices such as lighting equipment or monitors etc. are increasingly used to direct the viewer's attention to certain elements. However, in the state of the art the arrangement of such lighting equipment or generally electrical devices requires electrical wiring, which greatly limits the flexibility regarding a variable arrangement of the electrical device or lighting equipment. In the same way, an attractive presentation is of increasing importance in store fitting.

DE 10 2011 005 735 A1 discloses a system for a presentation, sales or exhibition stand and/or for store fitting comprising at least one wall, floor or ceiling member having a carrier material and a cover covering the same, wherein electrical conductor tracks are provided on the carrier material or arranged on/in the cover and wherein the carrier material and/or the electrical conductor tracks can be magnetized, i.e. have ferromagnetic properties; and comprising at least one electrical device which can be attached to the carrier material by means of at least one magnet, wherein the electrical device comprises needle-shaped current collectors which penetrate the cover when the electrical load is attached to the carrier material and thereby make electrical contact with the conductor tracks and supply the electrical device with current.

The system known from DE 10 2011 005 735 A1 makes it possible to provide a wall member, for example for a presentation, sales or exhibition stand or for store fitting, which in particular enables an easily changeable and therefore flexible arrangement of electrical devices on the wall member.

DE 10 2013 011 329 A1 discloses a display stand and a method for assembling a display stand. The display stand has a presentation wall and at least one object held on it, wherein the presentation wall and the object have interacting latching contours on abutting, which allow the object to be held on the presentation wall in a plurality of different, pre-defined positions; the object being held on the presentation wall by magnetic forces; the latching contours are designed such that the smallest possible distance between mutually displaces latching positions of the object is smaller than the extension of the contact surface of the object measured in the displacement direction; and at least in a part of the possible positions of the object on the presentation wall, a direct power supply of the object through the contact surfaces is provided via the presentation wall.

SUMMARY OF THE INVENTION

Against this background, it can be among others an object of the present disclosure to provide an improved system for a presentation, sales or exhibition stand and/or for store fitting, which allows in a simple way a freely selectable and flexibly changeable arrangement of an electrical consumer device on a wall member.

According to a first aspect of the present disclosure, a system, in particular for a presentation, sales or exhibition stand and/or for store fitting, is proposed, the system comprising:

- a current-carrying wall member and
  - a current collector for an electrical device, which is configured to be mounted on the wall member;
  - wherein the wall member comprises a carrier plate having a front side and a back side;
  - wherein the wall member comprises first electrical conductor tracks (of a first polarity) and second electrical conductor tracks (of a second polarity), wherein the first and second electrical conductor tracks are arranged alternately at least in sections; wherein the first electrical conductor tracks and the second electrical conductor tracks are arranged on the front side of the carrier plate;
  - wherein the current collector comprises a plurality of at least two contact needles, wherein the current collector is adapted to be attached to the wall member such that at least one of the contact needles contacts one of the first electrical conductor tracks and at least one other of the contact needles contacts one of the second electrical conductor tracks; and
  - wherein the wall member comprises a first electrical terminal contact and a second electrical terminal contact, wherein the first electrical terminal contact is electrically conductively coupled to the first electrical conductor tracks, wherein the second electrical terminal contact is electrically conductively coupled to the second electrical conductor tracks, and wherein the first electrical terminal contact and the second electrical terminal contact are arranged on the back side of the carrier plate.

According to a second aspect of the present disclosure, a corresponding wall member (for use) in a system for a presentation, sales or exhibition stand and/or for store fitting is proposed.

According to a further aspect of the present disclosure, the use of such a wall member in such a system is proposed for a presentation, sales or exhibition stand and/or for store fitting.

According to a further aspect, a corresponding method of manufacturing a corresponding wall member for a system for a presentation, sales or exhibition stand and/or for store fitting.

The inventors recognized that the handling of current-carrying wall elements in shopfitting is a new kind of challenge for the employees involved. In previous systems, there is often a separation between the tasks of a designer or decorator and the subsequent supply of electrical energy. It would thus be desirable to also make it easier for designers and decorators to deal with current carrying (live) wall members. Furthermore, it would be desirable to reduce the time required to design or redesign a shop window. This is particularly true in view of the fact that shop windows are often re-modelled outside normal opening hours, including at night or at weekends.

According to the present disclosure, it is thus proposed to provide a wall member comprising a carrier plate having a front side and a back side; wherein the wall member comprises first electrical conductor tracks of a first polarity and second electrical conductor tracks of a second polarity. The first and second electrical conductor tracks can at least in sections be arranged alternately. The first electrical conductor tracks and the second electrical conductor tracks are arranged on the front side of the carrier plate. The first electrical conductor tracks are electrically conductively coupled with each other. The second electrical conductor tracks are electrically conductively coupled with each other. The wall member further comprises a first electrical terminal contact and a second electrical terminal contact. The first electrical terminal contact is electrically conductively coupled to the first electrical conductor tracks. The second electrical terminal contact is electrically conductively coupled to the second electrical conductor tracks. The first electrical terminal contact and the second electrical terminal contact are arranged on the back side of the carrier plate. Further measures are explained below by way of example.

The proposed solution is based on the general idea that a current-carrying wall serves as the source and an adapter or current collector is provided to tap electricity from the wall. The wall member can be adapted to be connected to a current or voltage source such as a power supply. The first electrical tracks can be connected to a positive pole via the first backside electrical terminal contact and the second tracks to a negative pole via the second backside electrical terminal contact. For example, a DC voltage of 12V or 24V can be provided. Alternatively, a different type of power supply, such as an AC voltage or a DC voltage with a superimposed AC voltage can be provided via the first and second electrical terminal contacts. The wall member can have a carrier plate and optionally a cover that covers it. The combination of carrier plate and cover is especially advantageous for such presentation stands, because a cover can be changed quickly and the stand can be easily adapted. The cover may extend over a wall member or a group of wall members. For example, such a cover can be printed and/or labeled. The current collector and/or the electrical device can be adapted to be mounted on or attached to the wall member.

The conductor tracks of the electrical wall member can be an integral part of the carrier element, for example in the form of a punched steel plate, and can be arranged on the carrier material and/or on or in the cover. It shall be understood that a wall member may also have a layered structure. Such a layered structure can have one or more of the following layers: a support structure, such as wood or metal, a layer of a magnetic or magnetizable material, such as steel, an insulation layer, and a conductor track layer, e.g. of a (thin) metal foil. For example, a carrier plate or support structure, e.g. made of plastic, may be provided, on which a layer of a magnetic or magnetizable material, e.g. steel, is applied, which may optionally be adapted as a first and/or second conductor track at the same time, and optionally a cover can be provided. The use of a layer of a magnetic or ferromagnetic material is advantageous, because a current collector or consumer can be flexibly attached to the wall member with magnets. Advantageously, the first and second backside terminal contacts may be part of the layer structure of the wall member.

The current collector comprises a plurality of at least two or at least three contact needles, for example exactly two. The current collector is adapted to be mounted on the wall member in such a way that at least one of the contact needles contacts one of the first electrical tracks and at least one other of the contact needles contacts one of the second electrical tracks. For example, in the case where the conductive tracks are arranged on the carrier plate of the wall member and the wall member has a cover that covers the carrier plate, the contact needles may be adapted to penetrate the cover and make an electrical connection with the respective conductive tracks. The contact needles can pierce through or into the wall member. It is also possible that the electrical conductors are integrated into the cover, in particular woven into it. In this case, first electrical conductor tracks of the cover may be connected to the first back-side terminal contact and second electrical conductor tracks of the cover may be connected to the second back-side terminal contact. The cover may optionally be considered part of the wall member. Basically, the current collector can be adapted to establish an electrical connection with the first and the second conductor track when placed on the wall member and to supply the tapped voltage to a consumer or load device.

Advantages of the proposed solution in comparison to conventional store or trade fair construction may in particular that a complex cabling of the individual electrical devices attached to the presentation element can be omitted. Instead, the consumer devices can be flexibly attached to the presentation element on-the-fly. Expensive corrections can thus be omitted. In addition, creativity can be promoted, since the individual consumers can be flexibly repositioned and aligned, especially also with regard to their rotation relative to the wall member. In a way, such a system invites to play and experiment with the arrangement of the electrical consumer devices in order to achieve the most appealing presentation result. In particular, the current-carrying wall member can be charged with electricity even before the consumers are attached and the result can be assessed immediately. A time-consuming new wiring is not necessary.

It is to be understood that the current collector can either be attached as such to the wall member and the tapped current can, for example in a wired manner, be fed to a consumer device, or the current collector can be integrated into a holder or integrated in an electrical consumer device.

A system for a presentation, sales or exhibition stand and/or for store fitting can also be referred to as a display or show stand. A wall member in the context of the present disclosure can also refer to a floor element or a ceiling element. In the context of the present disclosure, a contact needle can also refer to a contact pin or contact stick, which does not necessarily have a pointed tip. The contact needles can be arranged in such a way that these or the tips or ends of the contact needles lie in one plane. Optionally, the contact needles can be spring-loaded. The contact needles can be adapted to penetrate the cover. In the context of the present disclosure, an equilateral or equilateral triangle can optionally be understood to be a triangle in which the lengths of the legs or sides do not differ by more than 20%, preferably by more than 10%, preferably by more than 5% each relative to one of the other legs or sides.

An extension of the first electrical conductor tracks can be guided around a (first) edge of the carrier plate from the front side to the back side of the carrier plate and can be electrically conductively coupled to the first connection contact. An extension of the second electrical conductor tracks can be guided around a (second) edge of the carrier plate from the front side to the back side of the carrier plate and can be electrically conductively coupled to the second connection contact. An advantage of this example may be a simple low-cost manufacturing.

The first electrical conductor tracks and the second electrical conductor tracks can form an interlining/engaging comb structure. The first electrical conductor tracks can form a first comb and the second electrical conductor tracks can form a second comb, wherein for at least one of the two combs the prongs of the comb structure are arranged on the front side of the carrier plate and a web of the comb structure connecting the prongs is arranged on the back side of the carrier plate. An advantage of this solution can be a more flexible positioning of the current collector, in particular in edge regions. By arranging the connecting web of the comb structure on the back side, the current collector can also be flexibly positioned in the edge regions of the wall member.

The electrical conductor tracks on the front side and the electrical terminal contacts on the back side can comprise a common electrically conductive layer. The electrically conductive layer is guided or wrapped around an edge of the carrier plate from the front side of the carrier plate to the back side of the carrier plate. In other words, the first electrical conductor tracks and the first electrical terminal contact on the back side may comprise a common electrically conductive layer. The second electrical conductor tracks and the second electrical terminal contact on the back side may comprise a common electrically conductive layer. It shall be understood that there is no electrically conductive link between the first and second electrical conductor tracks, otherwise a short circuit may occur. The common electrically conductive layer, may thus comprise two sub-regions insulated from each other, a first sub-region of the first polarity and a second subregion of the second polarity, wherein the first sub-region comprises the first electrical conductor tracks and the first electrical terminal contact, and the second sub-region comprises the second electrical conductor tracks and the second electrical terminal contact. An advantage of this solution may be simple, low-cost production. An advantage may be that contact problems may be reduced.

In a refinement, the electrical conductive tracks on the front side and the electrical terminal contacts on the back side can comprise a common electrically conductive foil which is applied to the carrier plate. An advantage may be a simple, low-cost production. It shall be understood that such a foil may optionally comprise further layers, or that a plurality of foils may be provided one above the other. For example, in the case of a carrier plate made of steel or another conductive material, an insulating layer may be provided between the carrier plate and an electrically conductive layer of the foil.

The first and the second electrical terminal contacts may be arranged rotationally symmetrically on the back side of the carrier plate. This can facilitate positioning. For example, a rotation of 180° may be possible. The electrical connection can thus be established at different rotation states. Alternatively or additionally, the first and the second electrical connection contact can be arranged mirror-symmetrically on the back of the carrier plate. In addition or in the alternative, the first and second electrical terminal contacts can be arranged mirror-symmetrically on the back side of the carrier plate.

The first and second electrical terminal contacts can be arranged at diagonally opposite corners on the back side of the carrier plate. A corner-side arrangement on the back side preferably allows contact with further adjacent carrier plates to be established in an efficient manner.

The wall member can further comprise a third electrical terminal contact and a fourth electrical terminal contact. The third electrical terminal contact can be electrically conductively coupled to the first electrical conductor tracks. The fourth electrical terminal contact can be electrically conductively coupled to the second electrical conductor tracks. The third electrical terminal contact and the fourth electrical terminal contact can be arranged on the back side of the carrier plate. In particular, four electrical terminal contacts may thus be provided on the back side of the carrier plate. These may be arranged rotationally symmetrically by 90°.

The wall member can be square. This can simplify the handling of the wall members, in particular in conjunction with four, preferably 90° rotationally symmetrically arranged terminal contacts, since such wall members may be applied independent of the orientation (in 90° steps).

The first electrical terminal contact can be arranged in a first edge region on the back side of the carrier plate. The second electrical terminal contact can be arranged in a second, preferably opposite edge region on the back side of the carrier plate. An advantage of this example may be that less material may be necessary. This applies in particular if the back side terminal contacts are connected to the respective front-side conductor tracks via extension of the front-side conductor tracks.

The first electrical terminal contact can extends along a first edge of the back side of the carrier plate. The second electrical terminal contact can extends along a second, opposite edge of the back side of the carrier plate. For example, the first and/or second connection contact may extend along at least 50%, in particular along at least 75%, in particular along at least 85%, in particular along at least 95% of an edge. This may improve a durability of the wall members, in particular when a common electrically conductive foil is used. A further advantage may be that fewer cuts are required during manufacturing, and thus manufacturing may be simplified.

The first and second electrical terminal contacts on the back side can be coupled by electrical connections through the carrier plate to the respective corresponding electrical conductor track on the front side. An advantage of this example may be that electrically insulating edges of the carrier plates can be provided.

The system can comprise a cover covering the front side of the carrier plate. The cover may be configured to cover one or more carrier plates simultaneously. A plurality of carrier plates may be surrounded by a common frame to which the cover may be attached. This may enable easy replacement of the cover.

The wall member and the current collector can be adapted such that the current collector can be magnetically attached to the wall member.

The system can comprise a plurality of at least two, in particular at least four, in particular at least nine of the wall members. The system can further comprise an electrode arrangement for supplying power to the wall elements via the first and second connection contacts on the back side. The electrode arrangement may optionally be configured to supply power to the back of the wall members via the first and second terminal contacts, and at the same time serve to attach the wall members to a wall.

In a refinement, the electrode arrangement can comprise a first group and a second group of electrodes. Said first group of electrodes can be adapted and arranged to connect said first electrical terminal contacts of said respective wall elements to a first polarity. Said second group of electrodes can be adapted and arranged to connect said second electrical terminal contacts of the respective wall elements to a second polarity. For example, the electrodes of the first group and the electrodes of the second group may be arranged in different rows and/or columns, in particular arranged in a checkerboard pattern.

The electrode arrangement can further be adapted such that the wall elements are magnetically attachable to the electrode arrangement. In particular can the electrode arrangement comprise electrically conducting magnets. An advantage of this example may be that the magnetic attachment of the wall members simultaneously provides a power supply to the wall members.

Optionally, the system may comprise two types of wall members. A first type of wall member as described above with electrical conductor tracks, an a second type of wall member without front side conductor tracks. In general, the system can comprise at least one wall member without front side conductor tracks. An advantage of this example can be that certain areas of a display window, in which electrical consumers are to be attached, can be equipped with the more complex wall members comprising the electrical conductors in a targeted manner. However, in the other areas, less expensive wall members without such electrical conductors may be provided. In other words, the system may include a first wall member or group of wall members with front side conductor tracks and a second wall member or group of wall members without front side conductor tracks. Optionally, a wall member without front side conductor tracks may have a back side electrical insulation. The electrical insulation may be provided at least in an area where contact with an electrode for power supply could occur, in particular to avoid electrical connection to one or more electrodes of the electrode arrangement.

According to a further aspect of the present disclosure, a method of manufacturing a wall member for an aforementioned system is provided, the method comprising the steps:

- providing (ferromagnetic) a carrier plate, wherein the carrier plate has a front side and a back side;
- applying first electrical conductor tracks of a first polarity and second electrical conductor tracks of a second polarity, wherein the first and second electrical conductor tracks are arranged alternately at least in sections; wherein the first electrical conductor tracks and the second electrical conductor tracks are applied on the front side of the carrier plate;
- applying a first electrical terminal contact and a second electrical terminal contact on the back side of the carrier plate, wherein the first electrical terminal contact is electrically conductively coupled to the first electrical conductor tracks, and wherein the second electrical terminal contact is electrically conductively coupled to the second electrical conductor tracks.

In particular, the method may comprise the step of: providing an electrically conductive foil, having a first electrically conductive region comprising the first electrical conductor tracks and the first terminal contact, and having a second electrically conductive region comprising the second electrical conductor tracks and the second terminal contact. The electrically conductive foil can then be applied to the carrier plate such that the electrical conductor tracks of the first and second polarity are provided on the front side, and the first and second connection contacts are provided on the back side.

According to a further aspect of the present disclosure, a system, in particular for a presentation, sales or exhibition stand and/or for store fitting, is proposed, the system comprising:

- a current-carrying wall member and
- a current collector for an electrical device (electrical consumer device), which is configured to be mounted on the wall member;
- wherein the wall member comprises a carrier plate and a cover (covering) that covers the carrier plate;
- wherein the wall member comprises first electrical conductor tracks (of a first polarity) and second electrical conductor tracks (of a second polarity), wherein the first and second electrical conductor tracks are arranged alternately at least in sections;
- wherein the current collector comprises a plurality of at least three contact needles,
- wherein the current collector is adapted to be attached to the wall member such that at least one of the contact needles contacts one of the first electrical conductor tracks and at least one other of the contact needles contacts one of the second electrical conductor tracks; and
- wherein a first contact needle, a second contact needle, and a third contact needle of said plurality of contact needles are arranged on a circle. Features according to this further aspect may advantageously be combined with features of the wall member with the backside contacting as described above.

According to a further aspect of the present disclosure, a corresponding current collector for an electrical consumer (for use) in a system for a presentation, sales or exhibition stand and/or for store fitting is proposed.

According to a further aspect of the present disclosure, the use of such a current collector in such a system is proposed for a presentation, sales or exhibition stand and/or for store fitting.

According to a further aspect, a corresponding method is proposed for or for the equipping of a presentation, sales or exhibition stand and/or for store fitting.

The solution disclosed in DE 10 2011 005 735 A1 enables a substantially free positioning in a horizontal and vertical direction on current-carrying wall member. However, with conventional needle connectors, there is the problem that the rotation of the current collector relative to the current-carrying wall member can cause both contact needles to come to rest on the same electrical conductor track. For example, a current collector or an electrical consumer comprising a current collector cannot simply be rotated by 90°. It would thus be desirable to further improve the positionability and to still establish an electrical contact even with different angular orientations.

Optionally, the current collector may not only comprise two contact needles but a plurality of at least three contact needles, wherein a first contact needle, a second contact needle, and a third contact needle of the plurality of contact needles are arranged in such a way that they lie on a circle or arc of a circle. Due to the proposed arrangement of the contact needles on a circle arc, in addition to a relatively free positioning, e.g. in horizontal and/or vertical direction, an additional degree of freedom can be created, which can enable a freer rotation.

Thereby, the probability that at least one of the contact needles contacts one of the first electrical tracks and at least one other of the contact needles contacts one of the second electrical tracks can be increased. In other words, the contact of at least two contact needles with the respective tracks of different polarity can be maintained longer upon rotation. Further measures to enable a substantially free rotation are explained in the examples below.

Alternatively or in addition to the above arrangement of the first, second and third contact needles, the first, second and third contact needles may be arranged in such a way that a first straight line through the first and second contact needles and a second straight line through the second and third contact needles intersect at an (acute) angle.

The first, second and third contact needle of the current collector can be arranged in such a way that they form a triangle, in particular an acute-angled triangle. An acute-angled triangle is a triangle in which all angles are smaller than 90°. The three sides can, but do not have to be of different lengths.

The first, the second and the third contact needle of the current collector can be arranged in such a way that they form an isosceles, in particular an equilateral triangle.

A triangular arrangement of the first, second and third contact needles lying on the circle or circular arc, in particular for an arrangement as an approximately equilateral triangle, may allow a more flexible positioning, in particular with regard to a rotation of the current collector on the wall member.

A diameter of the circle on which the first contact needle, the second contact needle and the third contact needle are located can be smaller than or equal to the sum of a width of one of the first conductor tracks and a width of one (adjacent) of the second conductor tracks, and optionally a gap between them. An advantage of this solution may be that when the current collector is rotated, different contact needles on the first or second conductor track come to rest on and enable contact of at least two contact needles on different conductor tracks over a larger angular range.

The contact needles of the current collector can be arranged in such a way that, when the current collector is attached to the current-carrying wall member, at least a first of the contact needles (lying on the circle) can be brought into contact with one of the first conductor tracks and a second contact needle (lying on the circle) can be brought into contact with one of the second conductor tracks, independently of a rotation (or alignment) of the current collector (in the plane of the circle or plane of the wall member) on the current-carrying wall member. It shall be understood that the contacting may not to be understood completely independent of rotation, but within the scope of the present disclosure as substantially independent of rotation, e.g. taking into account a tolerance of +−5° or +−10°, so that a contact needle does not fall in a gap between two adjacent conductor tracks. Such a gap may be provided to avoid a short circuit between two adjacent conductor tracks.

In other words, the contact needles of the current collector can preferably be arranged in such a way that, independently of a rotation of the current collector on the wall, at least one of the contact needles makes a connection with one of the first conductor tracks (e.g. the positive pole) and at least one other of the contact needles makes a connection with one of the second conductor tracks (e.g. the negative pole). Thus, an electrical power supply of a device via the proposed current collector can be made possible over a wide angular range.

The contact needles lying on a circle can be arranged in such a way that the first contact needle lies in a first third of the circle, the second contact needle lies in a second third of the circle and the third contact needle lies in a third third of the circle. For example, the circle can be divided into three circle segments of equal size and one of the three contact needles can be located in each of the three circle segments.

The current collector may further comprise a fourth, fifth and sixth contact needle. The first to sixth contact needle can be arranged as a hexagon. In particular, the contact needles can be arranged as a hexagon, in particular as an equilateral hexagon or star, with the contact needles forming the corners of the hexagon or the tips of the star respectively. However, it shall be understood, that a different number of contact electrodes may be provided, in particular four or more, five or more, six or more, seven or more, or eight or more.

The current collector and the contact needles may be arranged such that, when the current collector is attached to the wall member, at least two contact needles contact one or more of the first electrical conductor tracks and at least two of the contact needles contact one or more of the second electrical conductor tracks. This can be particularly advantageous for applications with high power consumption. Usually a current collector with 3 or 4 contact needles is sufficient for currents up to 2 A. However, a higher number of contact needles can be advantageous as the current per current collector can be reduced. For example, cheaper components may be used. For example, two standard diodes each for 2 A may be cheaper than a high-power diode designed for 4 A. Alternatively, several current collectors can be used in parallel to tap a required power. Experiments have shown that besides the supply of lamps also the supply of displays is feasible. With a combination, such as a parallel connection of several current collectors, outputs of up to 3,000 watts or more are generally feasible.

The contact needles can be arranged such that a distance between the first contact needle and a straight line through the second contact needle and the third contact needle is greater than a width of one of the electrical conductor tracks. In the alternative or in addition, a distance between the first contact needle and a straight line through the second contact needle and the third contact needle can be smaller than twice the width of one of the electrical conductor tracks, and optionally an insulation gap between them. An advantage of this arrangement may be that rotation is possible over a wide angular range.

The current collector may comprise a fourth contact needle and the fourth contact needle may be arranged within the circle on which the first, the second and the third contact needles are arranged. For example, the fourth contact needle may be arranged on a center of a circle or on a center of a triangle formed by the first, second and third contact needles. An advantage of this example can be that it further improves the probability of enabling a sufficient electrical connection of the current collector to the conductors. For example, the problem that two of the three contact needles lying on the circle may fall into an insulation gap between one of the first tracks and one of the second tracks can be addressed. In an advantageous refinement, the fourth contact needle can be arranged decentered at a distance from a center of the circle. It shall be understood that also the features of this example can be combined with the features of one or more of the previous or following embodiments or examples. A "fourth" contact needle can be understood as a further contact needle. For example, a fourth contact needle in the above mentioned arrangement as a hexagon can be understood as a first fourth contact needle and a fourth contact needle which is arranged within the circle according to the present example can be understood as a second fourth contact needle or further contact needle. It shall be understood that this second fourth contact needle or further contact needles can be arranged within a circle on which the first, second and third contact needles are arranged, but on which also further contact needles can be arranged.

The system may also comprise a rectifier. The rectifier may be adapted to provide an output voltage of defined polarity based on an input voltage applied to at least two of the contact needles. The rectifier can be part of the current collector, a separate element or part of the electrical device. For example, a bridge rectifier can be provided. In addition or in the alternative, the rectifier can be arranged in a device that can be connected to the current collector. The rectifier may comprise a first output contact and a second output contact. In order to limit the complexity of the circuitry and thus the costs of the rectifier, the current collector may preferably comprise exactly four or exactly three contact or exactly two contact needles. In particular with exactly four contact needles an advantage is the limited circuit complexity and the possibility to cover large angle ranges.

In a further refinement, the rectifier may have at least three inputs and (exactly) two outputs, whereby each of the at least three inputs is connected to a respective contact needle.

The current collector (optionally in combination with a holder) can be adapted such that the contact needles are movable between a contact position, in which the contact needles contact the conductive electrical tracks, and a non-contact position, in which the contact needles are separated from the tracks when the current collector is attached to the current-carrying wall member. Here the non-contact position can also be called a shifting position or moving position. Preferably, the current collector can be moved on the wall member to reach a desired position. When the desired position is reached, the contact needles can be lowered or brought into the contact position. In an example the current collector may comprise a holder, whereby the holder is adapted in such a way that the contact needles are brought into contact with the tracks by inserting, for example by sliding in, a device into the holder. For example, the contact needles are only activated when a connecting element is inserted or when a consumer device or housing is inserted or attached. An advantage can be an improved positionability in the non-contact position.

The current collector may be adapted such that, when the current collector is aligned horizontally or vertically (on the wall member), a straight line through the first and second contact needle intersects a horizontal or vertical axis of the current collector at an acute angle, in particular at an angle of not more than 30°, in particular at an angle of not more than 15°, in particular at an angle of not more than 5%.

Alternatively or additionally, the system may further comprise an electrical device (also referred to as consumer device), on which the current collector is arranged in such a way that a straight line through the first and the second contact needle intersects a horizontal or vertical axis of the electrical device at an acute angle, in particular at an angle of not more than 20°, in particular at an angle of not more than 10°, in particular at an angle of not more than 5%, when the electrical consumer is oriented horizontally or vertically (on the wall member).

In other words, the arrangement of the contact needles can be rotated by an (acute) angle relative to the orientation of the conductor tracks. The relative position of the contact needles and housing must be taken into consideration. An advantage of this solution can be an improved reliability in contacting. The inventors recognized that especially in store fitting, elements which are attached to the wall member are preferably mounted horizontally or vertically aligned. Furthermore, angles in the range between 25 and 65° are frequently used. Minor rotations, for example by 5° or 10° with respect to the horizontal or vertical, are more likely to be perceived as undesired tilting or misalignment. By choosing exactly such a rarely occurring angle, the probability that two contact needles lying on a line may coincide with an insulation gap between two adjacent electrical conductor tracks can be reduced.

At least one (but preferably all) of the contact needles may be adapted such that a tip of the contact needle has an angle between 60° and 20°, in particular between 45° and 25°, in particular of 30°. For an angle specified as 30°, a tolerance of +10°, in particular ±5, may be allowed. An advantage of this example can be a good penetration of the optional covering cover and a sufficient contact area while providing sufficient conductivity at the same time.

The wall member and the current collector can be arranged such that the current collector can be magnetically attached to the wall member. Alternatively, other fastening means or types of fastening, such as gluing or screws, can be used. However, the use of a detachable connection is preferred to enable subsequent design variations.

Advantages described above in detail for the first aspect of the disclosure may apply accordingly to the further aspects of the present disclosure.

It shall be understood that the features mentioned above and the features to be explained below can be used not only in the combination indicated in the respective embodiment or example, but also in other combinations or on their own, without leaving the scope of the present disclosure.

BRIEF DESCRIPTION OF THE DRAWINGS

Exemplary embodiments of the present disclosure are illustrated in the drawings and will be explained in more detail in the following description.

FIGS. 6A-E show a schematic illustration of a first exemplary wall member;

FIGS. 7A-E show a schematic illustration of a second exemplary wall member;

FIGS. 8A-E show a schematic illustration of a third exemplary wall member;

FIGS. 9A-E show a schematic illustration of a fourth exemplary wall member;

FIGS. 25A-C show a top view as well as first and second side views of a current collector for an electrical device;

FIG. 26 shows a perspective view of an exemplary current collector;

FIG. 27 shows a perspective view of an exemplary current collector with a magnetic holder;

DETAILED DESCRIPTION OF EXEMPLARY EMBODIMENTS

Figure 1:
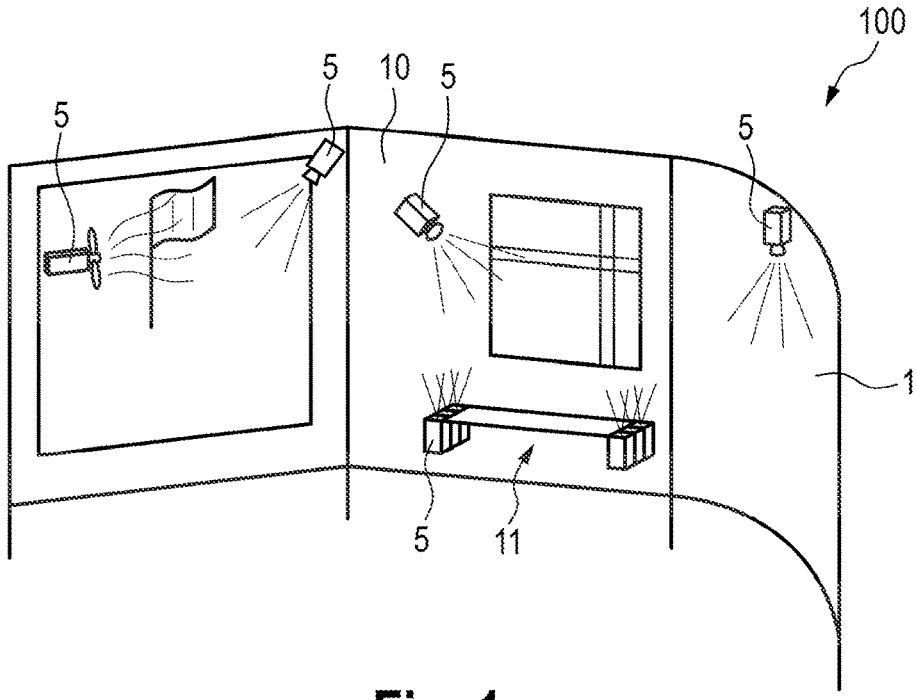
FIG. 1 shows an exemplary presentation stand with a system according to an embodiment of the present disclosure with several wall members.

FIG. 1 shows an exemplary presentation stand 100 or a shop window construction with a system according to an embodiment of the present disclosure. The presentation stand 100 comprises a plurality of wall members 10. Each side may be composed of a plurality of individual wall members. Various objects 5 can be attached to the wall members 10. For this purpose, various fasteners known from store fitting or trade fair construction can be used. In a preferred embodiment, the objects can be magnetically attached to the wall members 10. An advantage of this solution is that the objects 5 can be positioned freely on the wall members 10. It shall also be understood that corresponding floor or ceiling elements can be provided, which are also referred to as wall members in the context of the present disclosure for the sake of simplicity. The objects may be electrical devices 5, such as a light source, lighting equipment, a screen, a motor, a loudspeaker, a mannequin or the like. For the power supply, current collectors are provided which are electrically connected to the electrical consumers 5 or can be configured as part of the objects or electrical devices.

With the proposed wall member 10 and the associated current collector 20, presentation, sales or exhibition stands 100, especially in modern showrooms, can be easily modified and, in particular, easily adapted to local conditions, thus providing a high degree of flexibility with regard to the design freedom of the presentation, sales or exhibition stand 100. Such wall members 10 can also be used in store fitting. Furthermore, the system can advantageously also be used in museums or in the smart home sector.

Compared to conventional exhibition stands, there is no need for complex wiring of electrical devices, which not only simplifies assembly and disassembly considerably, but also allows the electrical consumers to be positioned almost freely and variably. For the construction of the presentation, sales or exhibition stand 100, several wall members 10 are typically assembled. With the proposed current-carrying wall members with back side contacting, the assembly can be further simplified.

Figure 2:
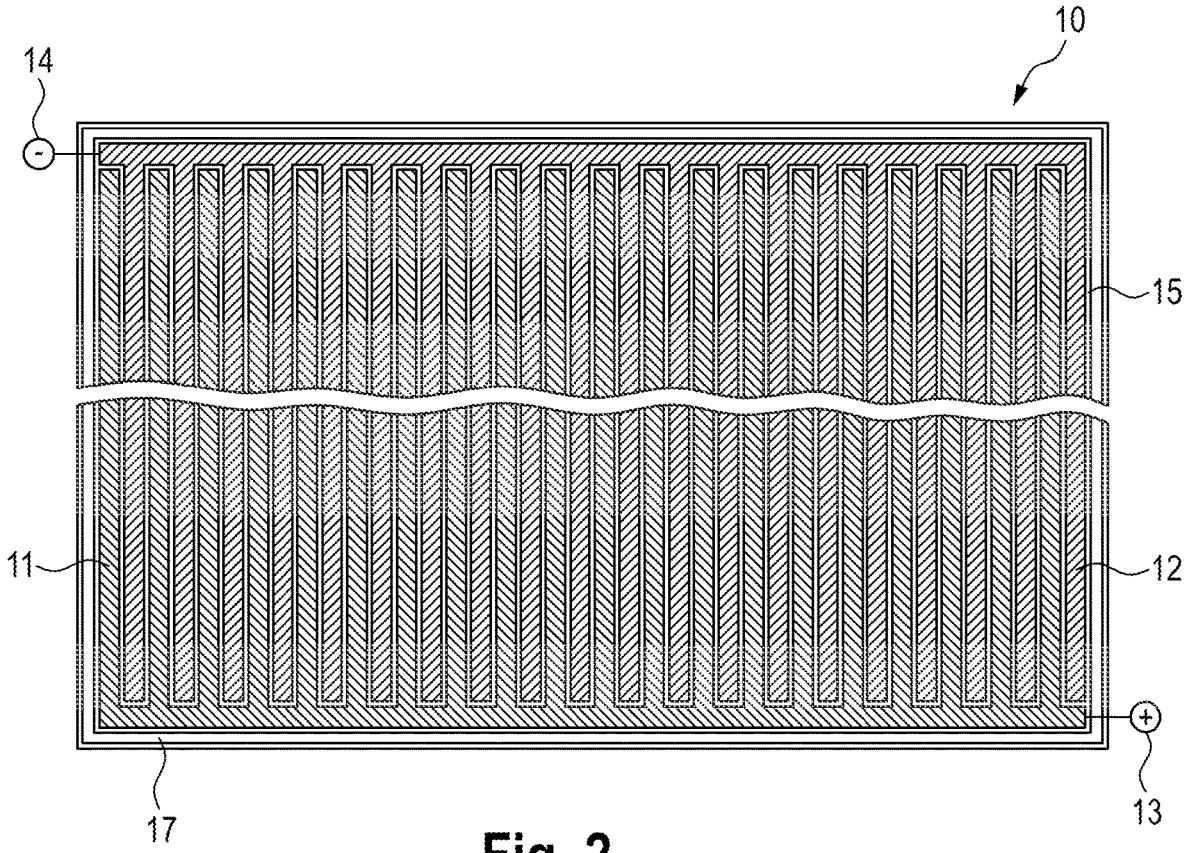
FIG. 2 shows a schematic illustration of a wall member without cover.
Figure 3:
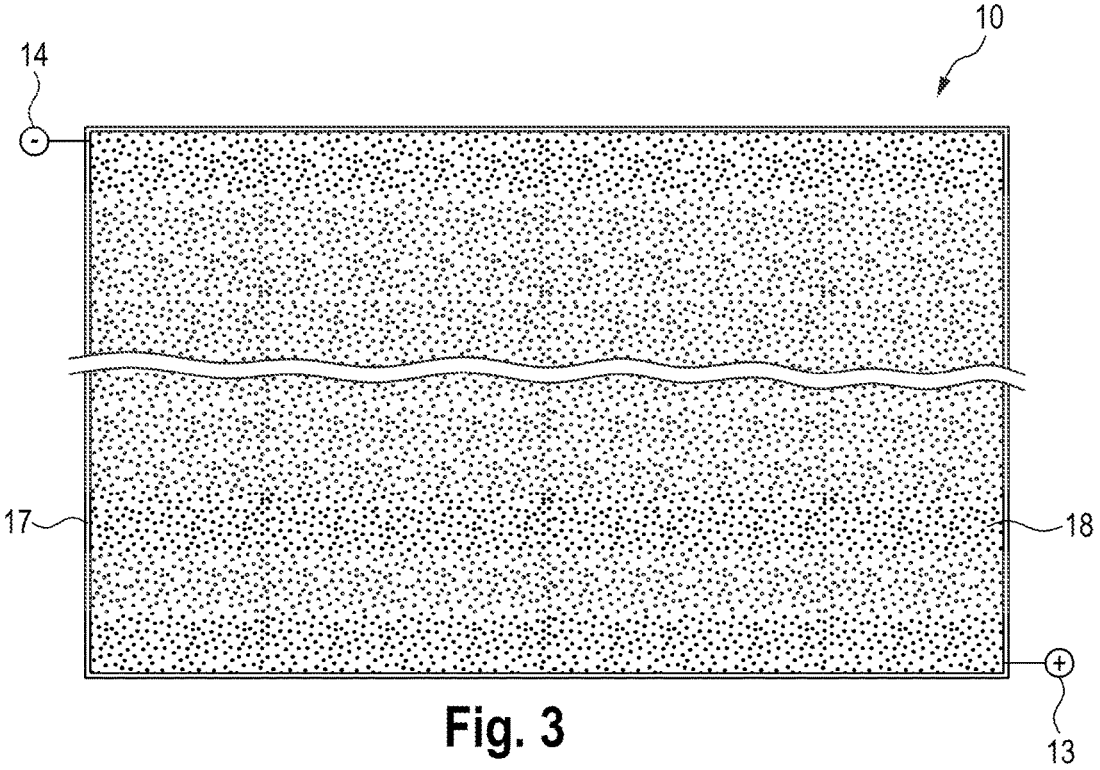
FIG. 3 shows a schematic illustration of a wall member with cover.

A peculiarity of the proposed system can be that the current collectors 10 or the electrical consumers 5 can not only be flexibly positioned on the wall members 1 with regard to their horizontal and vertical position, but that rotation can also be enabled. For this purpose, the proposed system comprises at least one current-carrying wall member 10 and a current collector 20 for an electrical device 5. An embodiment of a current-carrying wall member 10 is shown in FIGS. 2 and 3. Exemplary embodiments of current collectors are shown in FIG. 4 and the figures that follow.

FIG. 2 shows a schematic illustration of a first embodiment of a wall member 10 without cover. The wall member 10 comprises first electrical conductor tracks 11 of a first polarity and second electrical conductor tracks 12 of a second polarity. The first and second electrical conductors 11, 12 are arranged alternately at least in sections. The first electrical conductors 11 can form a first comb-like structure. The second electrical conductors 12 can form a second, corresponding comb-like structure, whereby the first comb-like structure and the second comb-like structure are formed such that the comb-like structures engage in one another. An insulation gap is provided between the first and second electrical conductors 11, 12. The insulation gap ensures that no short circuit occurs. Preferably, the width of the insulation gap should be as small as possible, for example less than 2 mm, in particular less than 1.5 mm, in particular less than 1.0 mm, in particular less than 0.5 mm, in particular less than 0.2 mm. The width of the isolation gap can be smaller than 1/10, especially smaller than 1/20 of a conductor track width. This can reduce the probability of one of the contact needles falling into the isolation gap. However, the insulation gap can be larger than a width of a tip of a contact needle of a current collector to avoid a short circuit between the conductive electrical tracks of the first polarity 11 and the conductive electrical tracks of the second polarity 12. The conductor tracks 11 of the first polarity are adapted to be connected to a first output of a voltage source, e.g. a positive pole 13. The conductor tracks 12 of the second polarity are adapted to be connected to a second output of a voltage source, for example a negative pole 14. Instead of a DC voltage, the conductor tracks 11, 12 can also be supplied with an AC voltage or a combination of DC and AC voltage. An area of the current-carrying wall member can be covered by at least 70%, in particular by at least 85%, in particular by at least 90% or 95% with the first and second conductor tracks. The conductor tracks 11, 12 can be part of a carrier element 15 of the wall member 10 or alternatively be applied on the carrier element 15. Advantageous embodiments of wall members with back side terminal contacts are shown in FIG. 6 and the figures that follow.

FIG. 3 shows a schematic illustration of a wall member 10, which comprises an optional cover 18. For example, the cover 18 can cover the electrical conductor tracks 11, 12 applied to the carrier plate 15. Alternatively, the conductor tracks 11, 12 can be part of the cover. In this case, the conductor tracks may have the same or similar geometry as the conductor tracks described above and shown in FIG. 2. To attach the cover 18 to the wall member 10, a piping rail 17 (or a piping profile) can be provided at the edge, into which e.g. a piping strip on the cover side can be inserted. The piping rail can be made of silicone or aluminum, for example.

Figure 4:
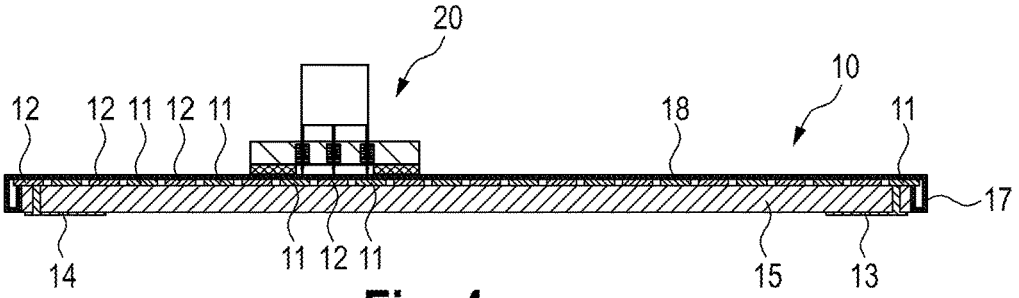
FIG. 4 shows a side view of a current collector attached to a wall member.
Figure 5:
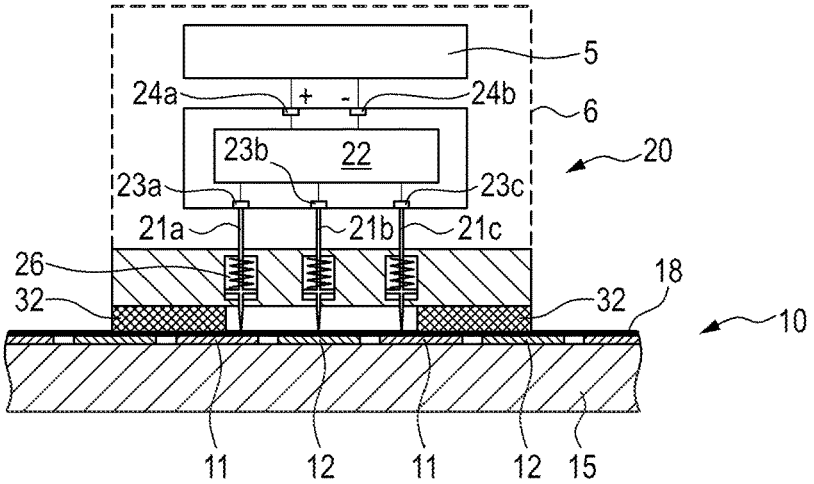
FIG. 5 shows an enlarged view of the current collector of FIG. 4.

FIG. 4 shows a side view of a system comprising a wall member 10 and a current collector 20 attached to the wall member 10. FIG. 5 shows an enlarged view of the current collector 20 from FIG. 4 on the wall member 10. The wall member 10 comprises a carrier plate 15 and optionally a cover 18 covering it. The wall member 10 also comprises first electrical conductor tracks 11 of a first polarity and second electrical conductor tracks 12 of a second polarity, the first and second electrical conductor tracks 11, 12 being arranged alternately at least in sections.

The wall member 10 comprises a carrier plate having a front side and a back side. The first electrical conductor tracks 11 and the second electrical conductor tracks 12 are arranged on the front side of the carrier plate 15. The wall member 10 comprises a first electrical terminal contact 13 and a second electrical terminal contact 14. As shown in FIG. 4, the first electrical terminal contact 13 is electrically conductively coupled to the first electrical conductor tracks 11. The second electrical terminal contact 14 is electrically conductively coupled to the second electrical conductor tracks 12. The first electrical terminal contact 13 and the second electrical terminal contact 14 are arranged on the back side of the carrier plate 15. For example, planar or areal terminal contacts 13, 14 can be provided. The terminal contacts 13, 14 can be brought into contact with corresponding connection elements or electrodes, for example on a wall or on a presentation stand, as shown for example in FIGS. 11 to 13, in order to supply electrical power to the wall member. A front side of the wall member may refer to that side of the wall member 10 on which the current collector 20 is attachable. A back side of the wall member may be understood as the side opposite to the front side.

In the example shown in FIG. 4, the first and second electrical terminal contacts 13, 14 on the back side are connected by electrical connections through the carrier plate 15 to the respective corresponding electrical conductor track 11, 12 on the front side.

The current collector 20 comprises a plurality of at least two, in particular at least three contact needles 21*a*, 21*b*, 21*c*. The current collector 20 is adapted to be mounted on the wall member 10 such that at least one of the contact needles 21*a* contacts one of the first electrical conductor tracks 11 and at least one other of the contact needles 21*b* contacts one of the second electrical conductor tracks 12. Here, a first contact needle 21*a*, a second contact needle 21*b*, and a third contact needle 21*c* of the plurality of contact needles can be arranged such that they are arranged on a circle, as explained in more detail with reference to FIG. 17 and the figures that follow.

To attach or mount the current collector 20 to the wall member 10, the wall member 10 and the current collector 20 can be adapted such that the current collector can be magnetically attached to the wall member. For example, the current collector 20 may comprise one or more magnets 32 as shown in FIGS. 4 and 5. The electrical conductor tracks 11, 12 and/or the carrier plate may comprise a magnetic material so that the current collector can adhere to it.

Figure 23:
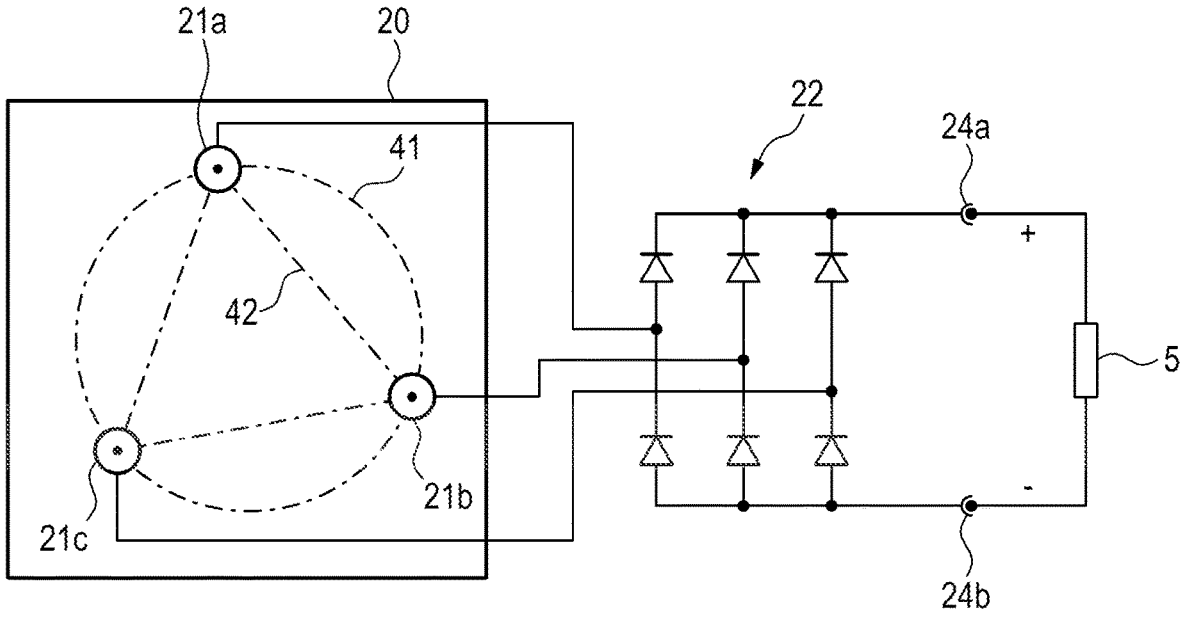
FIG. 23 shows an arrangement of three contact needles in combination with a rectifier.
Figure 24:
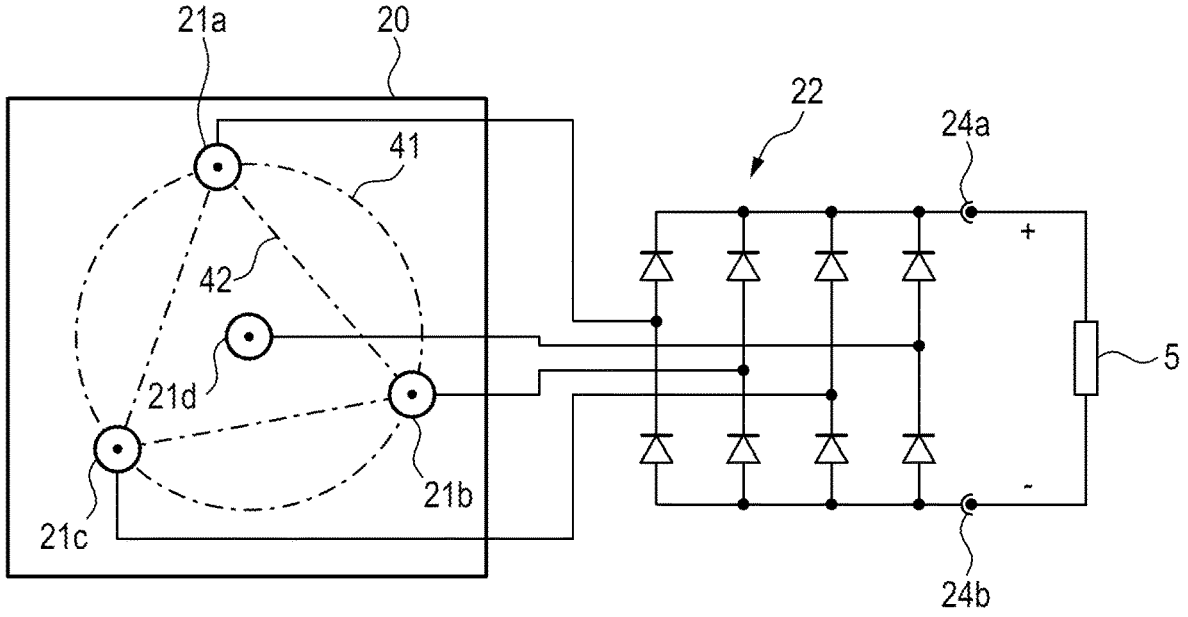
FIG. 24 shows an arrangement of four contact needles in combination with a rectifier.

The contact needles 21*a-c* of the current collector can be connected to a rectifier 22. The rectifier can be part of the current collector or part of an electrical device 5 that can be connected to the current collector. The rectifier 22 is adapted to provide an output voltage of defined polarity based on an input voltage applied to at least two of the contact needles 21*a-c*. Output pins 24*a*, 24*b* can be provided for this purpose, to which an electrical device 5 can be connected. The rectifier may comprise at least two, in particular at least three inputs 23*a-c* and two outputs 24*a,b*, each of the at least three inputs 23*a-c* being connected or connectable to a respective contact needle 21*a-c*. Exemplary embodiments of such rectifiers in the form of bridge rectifiers are shown in FIGS. 23 and 24. Optionally, the rectifier 22, the current collector 20 and the electrical device 5 can form a unit 6. Optionally, the current collector 20 and the rectifier 22 can be part of the electrical device 5.

It shall be understood that the current collector or contact needles can optionally comprise a contact spring 26 for the contact needles, as shown in FIG. 5, so as to provide a defined contact pressure.

FIGS. 6 to 8 show schematic illustrations of exemplary wall members. Herein denote: A a front view, B a rear view, C a first side view and D a second side view. In an optional embodiment, an electrically conductive layer 70, for example an electrically conductive foil may be provided, as shown in view E, which may be applied to the carrier plate.

As shown in FIG. 6A, the wall member 10 comprises first electrical conductor tracks 11 of a first polarity and second electrical conductor tracks 12 of a second polarity on the front side of the carrier plate 15. The first and second electrical conductor tracks 11, 12 are alternately arranged at least in sections. A current collector 20 placed on the wall member 10 may be arranged to establish an electrical connection to the first and second electrical conductor tracks 11, 12.

In the embodiment example shown in FIG. 6, an extension 61 of the first electrical conductor tracks 11 around an edge 63 of the carrier plate may be guided from the front side to a back side of the carrier plate 15. Accordingly, an extension 62 of the second electrical conductor tracks 12 may be guided around a (second) edge 64 of the carrier plate from the front side to a back side of the carrier plate 15. This is exemplarily shown in FIG. 6A to D.

FIG. 6C shows a side view of how the extension 61 is wraps around the edge of the carrier plate from the front side to the back side. The rear view is shown in FIG. 6B. The extension 61 of the first electrical conductor tracks 11 is electrically conductively connected to the first back side terminal contact 13. The extension 62 of the second electrical conductor tracks 12 is electrically conductively connected to the second back side terminal contact 14. Optionally, the extensions 61, 62 may serve as back side terminal contacts. However, the terminal contacts 13, 14 may comprise further elements. For example, the first and/or second backside terminal contacts 13, 14 may comprise a magnet for magnetically attaching the wall member to a support structure, such as an electrode assembly or a wall. A magnet or other attachment means may be provided as a separate element. Advantageously, current conducting magnets, such as conductively coated neodymium magnets may be used.

FIG. 6E shows an illustration of an electrically conductive layer 70 in an exemplary embodiment as an electrically conductive film. The electrical conductor tracks 11, 12 and the extensions 61, 62 may be implemented as a conductive foil. The extensions may thus be guided around the edges of the carrier plate in a simple manner. Hereby, parts of the electrically conductive layer 70 may serve as terminal contacts 13, 14. It shall be understood that an insulating layer 65 may be provided between the electrical conductor tracks 11, 12 and the carrier plate 15. This may prevent the conductive paths 11, 12 from being short-circuited by the carrier plate 15. For example, if the carrier plate 15 is made of a conductive material such as steel.

Figure 10:
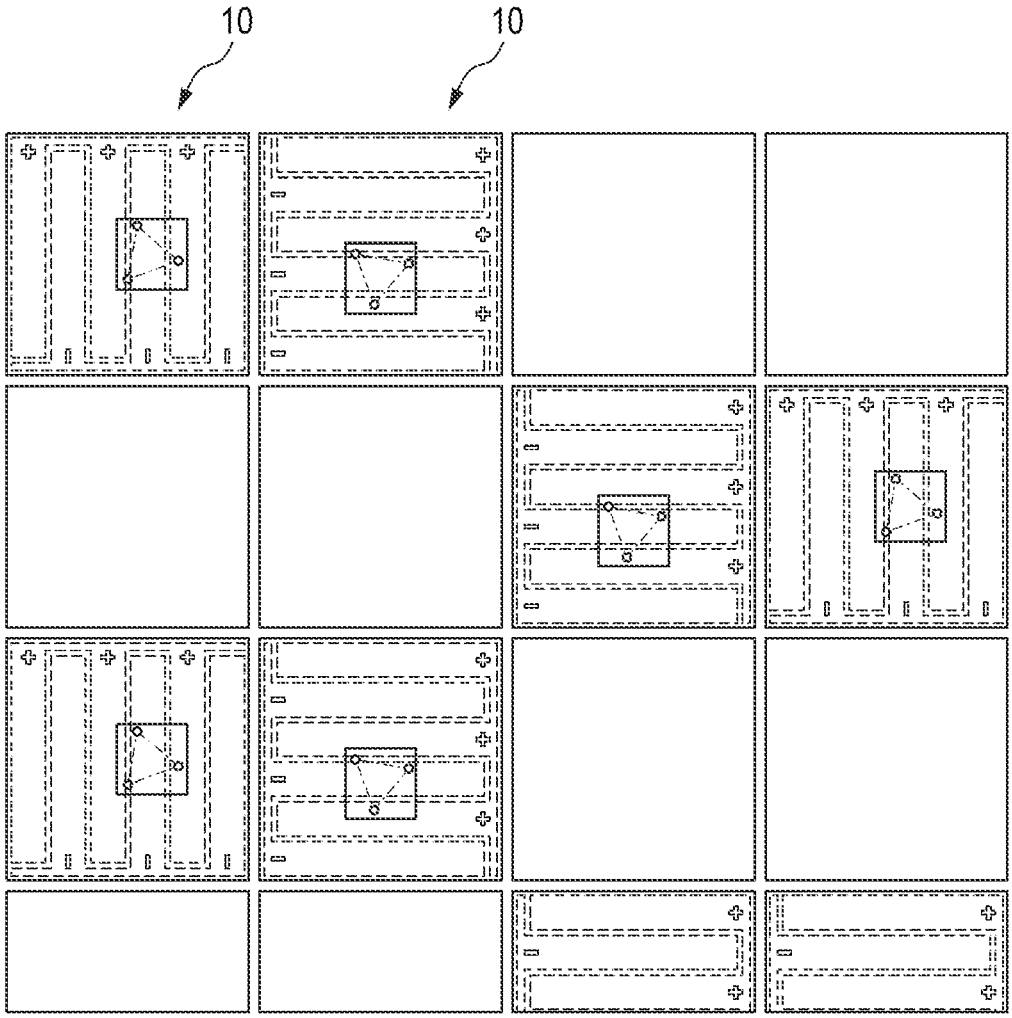
FIG. 10 shows a schematic illustration of a front view of a plurality of wall members.
Figure 11:
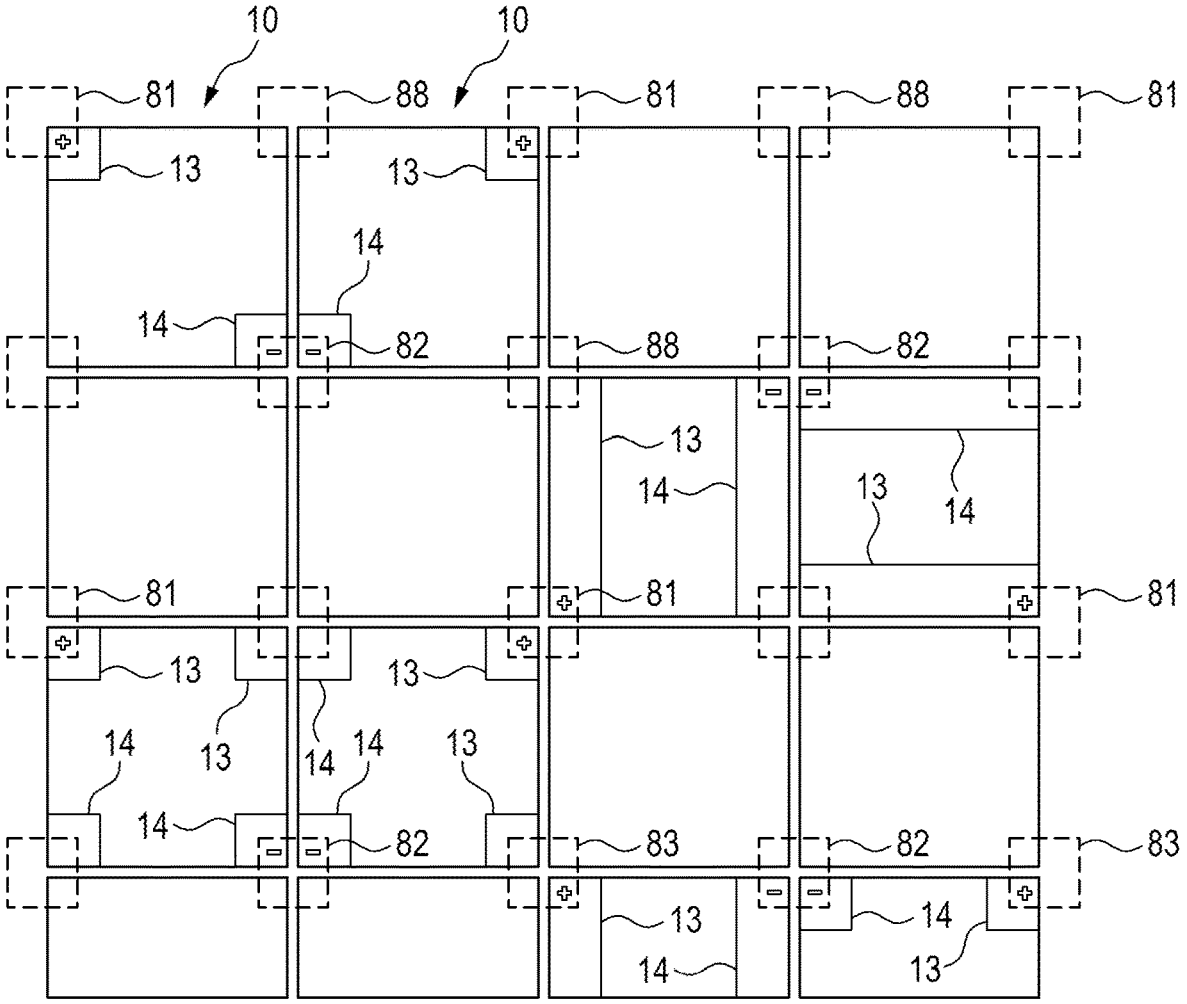
FIG. 11 shows a schematic illustration of a first rear view of a plurality of wall members.

Exemplary wall members are shown in FIGS. 10 and 11, respectively, in rows one, columns one and two with a front view and a rear view.

In embodiment, the extensions 61, 62 or terminal contacts 13, 14 may be arranged such that during manufacturing the extensions or terminal contacts may be arranged interleaved with each other. An advantage of this embodiment is that material is saved.

FIG. 7 shows a schematic illustration of another exemplary wall member 10. In order to avoid repetitions, in the following potential differences over the previously described embodiment will be highlighted.

As shown in FIG. 7A, the first electrical traces 11 and the second electrical conductor tracks 12 may form an engaging or interleaved comb structure. The first electrical conductor tracks 11 form a first comb and the second electrical conductor tracks 12 form a second comb. In the exemplary embodiment shown in FIG. 6A, for both combs, the prongs or tines of the comb structure are arranged on the front side of the carrier plate 15. In FIG. 6A, a web connecting the prongs is also arranged on the front side of the carrier plate 15. In contrast thereto, according to FIG. 7, for at least one of the two combs, a web 66 of the comb structure connecting the tines may be arranged on the back side of the carrier plate 15. Thereby, a better utilization of the area of the front side can be achieved. Also in the edge regions of the wall member 10, the probability that at least one of the contact needles of the current collector 20 contacts one of the first electrical conductor tracks 11 and at least another one of the contact needles contacts one of the second electrical conductor tracks 12 can thus be increased. In the exemplary embodiment shown in FIG. 7E, folded edges are shown as a dashed line 73 along which the foil can be wrapped around the edges 63, 64 of the carrier plate 15.

In FIGS. 6 and 7, generally the same or similar carrier plate 15 may be used. Different embodiments may be realized by covering the carrier plates 15 with a different film 70, as shown in FIG. 6E and FIG. 7E. It shall be understood that such a film may have a layered structure comprising multiple layers. At least one conductive layer may be provided to form the first electrical conductor tracks 11 and the second electrical conductor tracks 12. Further, at least one insulating layer may be provided to provide electrical insulation with respect to the carrier plate 15. Further, one or more cover layers may optionally be provided. This may, for example, also be a cover as described above.

As already described for FIG. 6, the first and second electrical terminal contacts 13, 14 may be formed directly by extensions 61, 62 of the electrical conductor tracks 11, 12.

In the backside view of the wall member 10 shown in FIG. 7B, the first and second electrical terminal contacts 13, 14 are arranged rotationally symmetrically on the back side of the carrier plate 15. This allows the wall members 10 to be mounted with more flexible orientation, as exemplarily shown in FIG. 10. In the context of the present disclosure, a rotationally symmetrical arrangement may refer to an arrangement wherein, when the carrier plate is rotated about its center point about an axis orthogonal to the front side of the carrier plate, at least a partial area of the second electrical terminal contact comes to rest at a position which corresponds to at least a partial area of the former position of the first electrical terminal contact 13. A partial overlap during rotation may thus be sufficient.

Optionally, the wall member 10 further comprises a third electrical terminal contact 13' and a fourth electrical terminal contact 14', wherein the third electrical terminal contact 13' is electrically conductively coupled to the first electrical conductor tracks 11 and wherein the fourth electrical terminal contact 14' is electrically conductively coupled to the second electrical conductor tracks 12. The third electrical terminal contact 13' and the fourth electrical terminal contact 14' are arranged on the back side of the carrier plate. In the shown exemplary embodiment, the carrier plate 15 is square. The four terminal contacts are arranged rotationally symmetrically on the back side of the carrier plate 15, in the present example in pairs at diagonally opposite corners on the back side of the carrier plate. This allows the plate to be mounted rotated by 90° on a wall or on a support structure, as shown in FIG. 10. Exemplary wall members are shown in FIGS. 10 and 11 in row three columns one and two respectively, with a front view and a rear view.

By arranging the contact elements 13, 14 in the edge areas on the left and right side of the back surface of the carrier plate 15, a material usage can be reduced. In particular, a central area of the rear surface of the carrier plate 15 can remain free.

FIG. 8 shows a further embodiment of a wall member 10. In this embodiment, the first electrical terminal contact 13 is arranged in a first edge region on the back side of the carrier plate 15 and the second electrical terminal contact 14 is arranged in a second opposite edge region on the back side of the carrier plate 15. Hereby, the connection contact may simultaneously provide the function of the web 66 of the comb structures connecting the respective conductive tracks 11 to each other. Optionally, the conductor tracks may be wrapped around to the back side of the carrier plate 15 and connected to each other by the extensions 61 of connection terminals formed as bars. Exemplary wall members are shown in FIGS. 10 and 11 in row two columns three and four respectively, with a front view and a rear view.

In the embodiment shown in FIG. 10, the system comprises a combination of wall members with front-side conductor tracks and wall members without front-side conductor tracks. Thus, simpler, less expensive elements can be used in areas where no power supply is required.

FIG. 9 therefore shows an exemplary embodiment of a wall member without conductive tracks on the front side. However, the wall member 10 may have an insulating layer 65, in particular in one or more regions 68 in which electrical contact is usually made.

FIG. 9E shows an insulation layer in the form of a flat film. Optionally, however, smaller foil areas may also be provided, for example as indicated in FIG. 9 E by reference sign 68. A part of the carrier plate 15 can remain free. This can save material.

FIGS. 10 and 11 show a schematic representation of a front view and a rear view, respectively, of a wall equipped with an arrangement of a plurality of wall members. For example, this may be the rear of a shop window or exhibition stand as shown in FIG. 1. Instead of large wall members, the system may comprise a plurality of wall members 10. An advantage arises in particular if the system has a combination of wall members with front-side conductor tracks and wall members without front-side conductor tracks. In this way, the manufacturing effort can be reduced and costs can be saved.

Advantageously, the wall members can be attached to the wall via a detachable connection, in particular magnetically. This allows the wall members to be easily exchanged and reorganized. For example, areas which were previously equipped with a wall member without front-side conductor tracks can now be provided with a wall member with front-side conductor tracks. Furthermore, the number of wall members with or without front-side conductor tracks can be increased or reduced. This allows an exact adaptation to the customer's requirements and the available budget. A subsequent upgrade is thus possible.

As shown in the rear view in FIG. 11, the system may comprise an electrode arrangement for supplying power to the wall members via the first and second rear connection terminals 13, 14. The electrode arrangement comprises a first group of electrodes 81 and a second group of electrodes 82. For example, a positive pole may be provided via the electrodes 81 and a negative pole may be provided via the electrodes 82. The first group of electrodes 81 is adapted and arranged to connect the first electrical terminal contacts 13 of the respective wall members with a first polarity. The second group of electrodes 82 is adapted and arranged to connect the second electrical terminal contacts 14 of the respective wall members 15 to a second polarity. The proposed arrangement allows the wall members to be flexibly arranged and, in particular, to be rotated in 180° or 90° steps.

An advantage of the proposed solution may in particular be that even designers and decorators without in-depth knowledge of electrical engineering can replace and reposition wall members. Even though turning wall members may lead to a change in the polarity of the first and second electrical conductor tracks. However, this is generally not critical. In the case of current collectors, it is also not known in advance which of the needles will be in contact with conductive paths of the first and second polarities. For example, a rectifier may thus be provided, as shown in FIGS. 23 and 24.

In FIG. 11, the electrodes of the first group 81 and the electrodes of the second group 82 are arranged in a checkerboard pattern in different rows and different columns. The electrode arrangement may include receiving elements or mounting elements 88, which may be located between the electrodes of the first group and the second group and are not current carrying. For example, a power supply may be provided via the checkerboard-like electrode arrangement of respective diagonally opposite corners of the wall members 10. For the further corners of the wall members 10, it is sufficient if these are merely mounted on one or more mounts or mounting elements 88 or even directly mounted on a wall or a mounting stand.

Optionally, the wall members 10 with the first and second conductor tracks as well as the backside terminal contacts contacting the same can be arranged in such a way that the wall member 10 may be shortened to a predetermined length. For this purpose, the first electrical terminal contact 13 and the second electrical terminal contact 14 may be arranged, at least in sections, on the same side or on the same edge on the back side of the carrier plate 15. Examples of wall members 10 which can be shortened in this way are shown in FIGS. 7 and 8. As shown in FIG. 11 row 4 columns 3 and 4, a length of the corresponding wall members 10 can thus be flexibly adapted to desired application scenarios.

Figure 12:
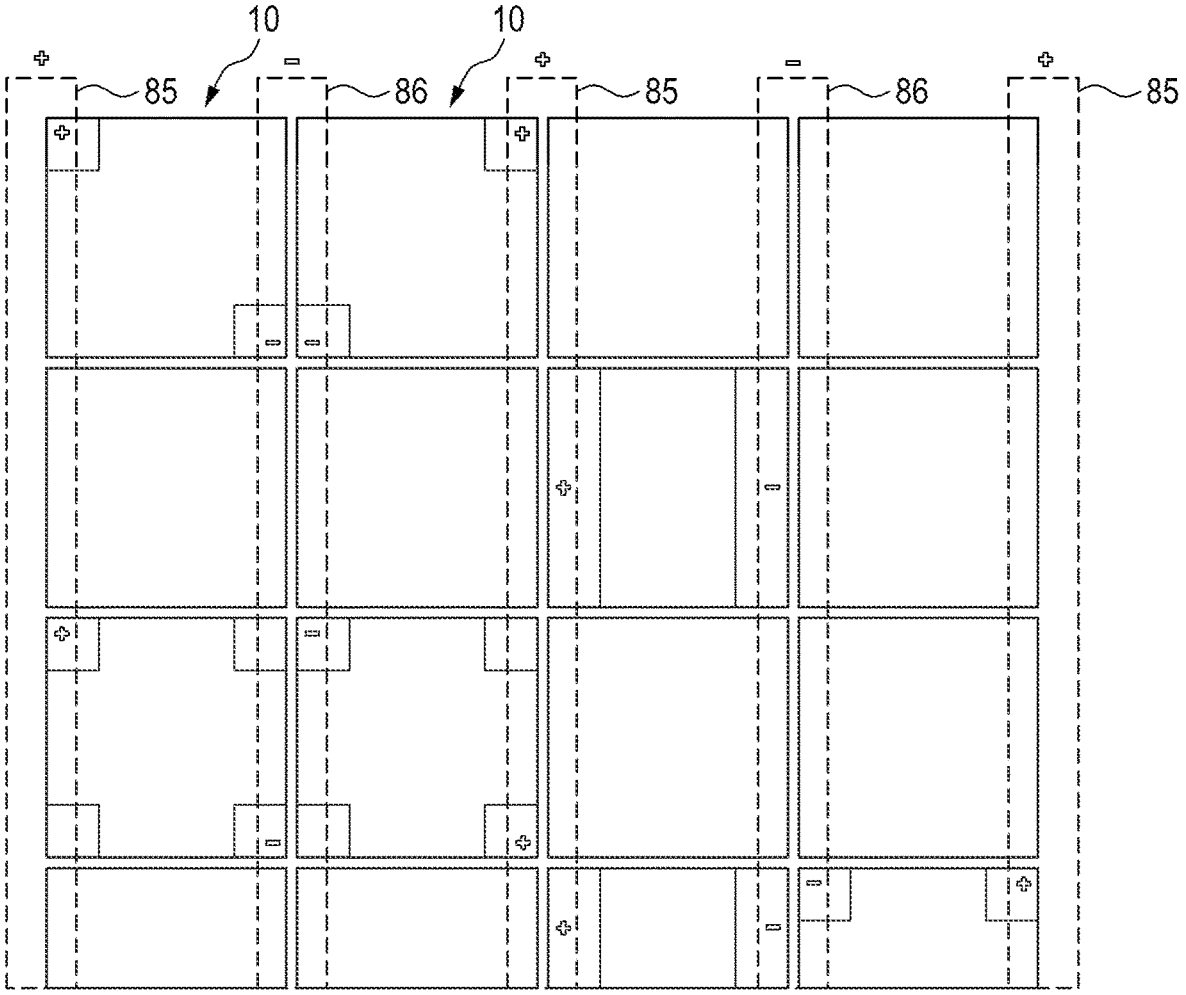
FIG. 12 shows a schematic illustration of a second rear view of a plurality of wall members.

FIG. 12 shows a schematic illustration of a second rear view of a plurality of wall members 10. The electrode arrangement herein comprises current-carrying longitudinal electrodes 85, 86. These may at the same time serve as mounting elements for the wall members 10. An advantage of this embodiment is easy assembly. It shall be understood that the possible rotation states of the wall members may be limited by the electrode arrangement. For example, in case of the wall members shown in FIG. 7 and FIG. 8, a short circuit must be avoided. This problem does not arise with the checkerboard arrangement of electrodes 81, 82 shown in FIG. 11. However, flexible rotation of the wall member shown in FIG. 6 or of the wall members shown in FIG. 10 line 1 columns 1 and 2 is possible in conjunction with the electrode arrangement shown in FIG. 12.

Figure 13:
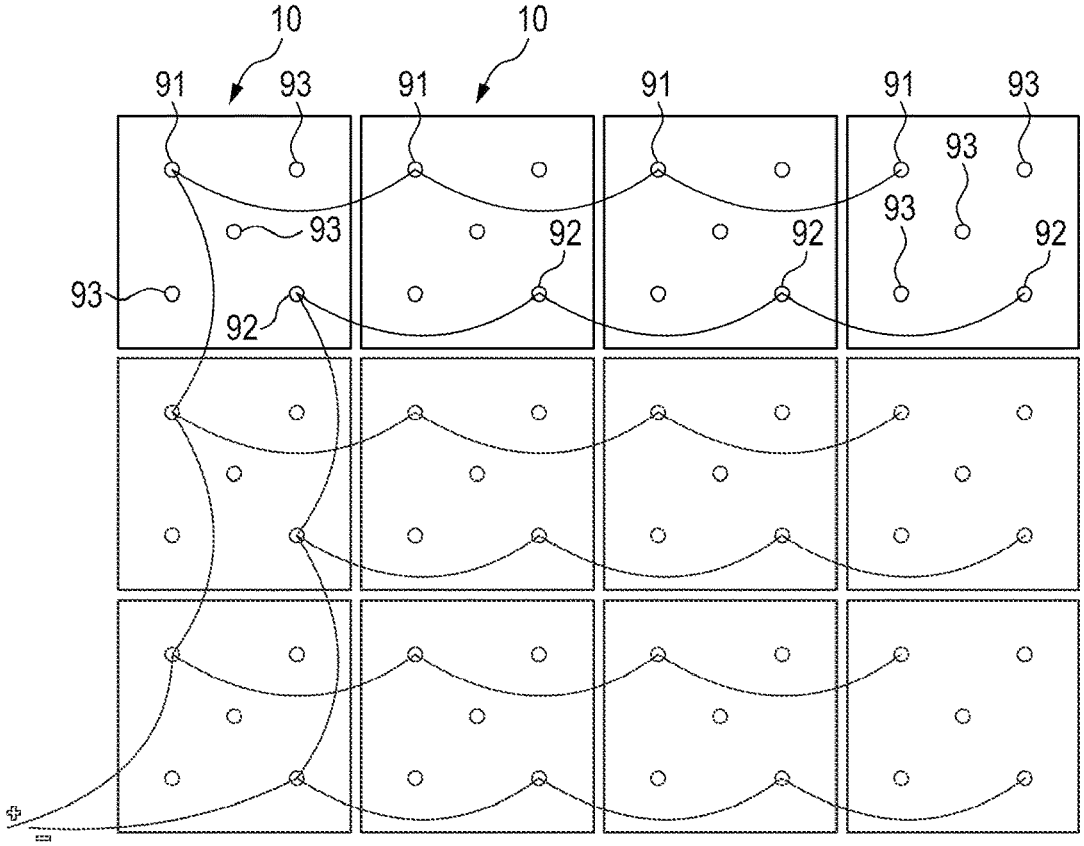
FIG. 13 shows a further schematic illustration of backside contacting of a plurality of wall members.

FIG. 13 shows a further embodiment of a backside contact arrangement for a plurality of wall members. Here, a plurality of electrodes may be attached to the wall, wherein the electrode arrangement comprises a first group of electrodes 91 connected to a first polarity, for example a positive pole, and a second group of electrodes connected to a negative pole.

Figure 14:
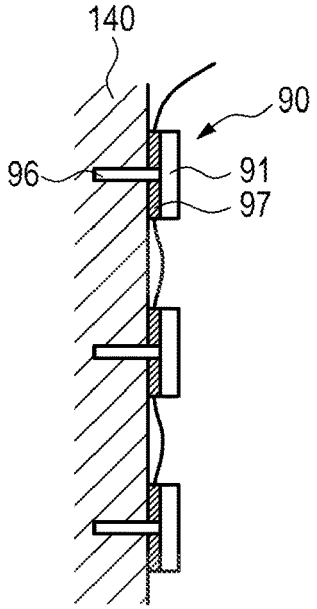
FIG. 14 shows a schematic illustration of a plurality of mounting elements.

An exemplary connection of multiple electrodes is shown in FIG. 14. An electrode 90 of the electrode arrangement may comprise a fastening means 96, for example in the form of a screw, which may be fastened in a wall 140, for example by means of a dowel. The electrode 90 may further comprise a retaining element, for example a magnet 95, by means of which the wall member 10 may be attached to the electrode. With this type of attachment, a synergistic effect may result if a load is also magnetically attached to the wall member. Furthermore, the electrode 90 may comprise a connector 97 to which a supply line may be connected. In particular, the connection 97 can be designed in such a way that a continuation to or contacting of further electrodes is possible.

In order to improve mechanical stability, non-contacted electrodes or elements may be provided, as indicated by reference numeral 93 in FIG. 13.

Figure 15:
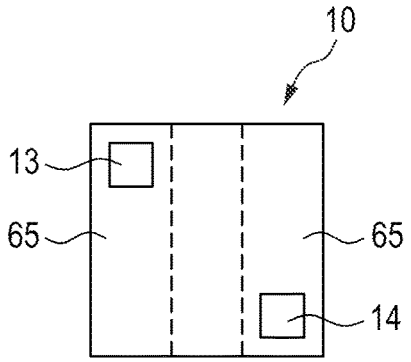
FIG. 15 shows a current-carrying wall member.

FIG. 15 shows a further example of a rear view of a current-carrying wall member with a first back side terminal contact 13 and a second back side terminal contact 14. An insulating layer 65 may be provided at least partially on the back side. It may have recesses for the first and second terminal contacts 13, 14.

Figure 16:
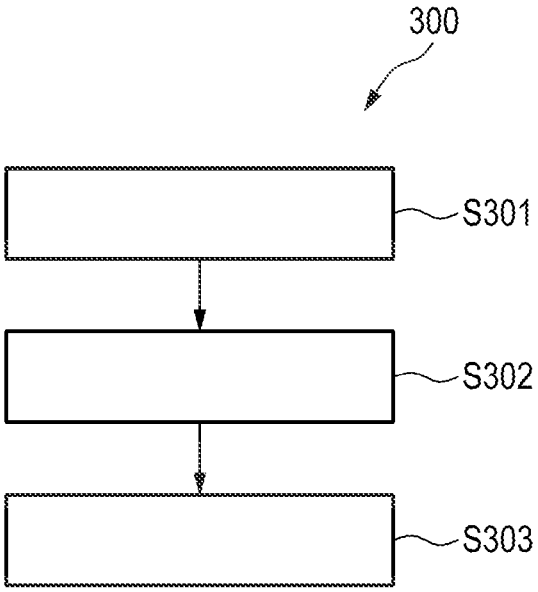
FIG. 16 shows a flow-chart of a method.

FIG. 16 illustrates a flow diagram of a method 300 for manufacturing a wall member.

In a first step S301, a (ferromagnetic) carrier plate is provided, the carrier plate having a front side and a back side.

In a subsequent step S302, first electrical conductor tracks of a first polarity and second electrical conductor tracks of a second polarity are applied, the first and second electrical conductor tracks being alternately arranged at least in sections; wherein the first electrical conductor tracks and the second electrical conductor tracks are applied to the front side of the carrier plate.

In a step S303, a first electrical terminal contact and a second electrical terminal contact are applied to the back side of the carrier plate, wherein the first electrical terminal contact is electrically conductively coupled to the first electrical conductor tracks, and wherein the second electrical terminal contact is electrically conductively coupled to the second electrical conductor tracks.

For example, for steps S302 and S303, an electrically conductive film as shown in FIGS. 6E to 8E may first be applied to the front surface of the carrier plate, according to step S302, and then folded around the edges of the carrier plate to be applied to the back surface, according to step S303.

Embodiments of the current collector and, in particular, various arrangements of the contact needles are described below.

FIGS. 17 to 20 show exemplary illustrations of arrangements of contact needles 21*a-f* on a current collector 20. The current collectors 20 comprise a plurality of at least three contact needles 21*a*-21*f* respectively, where a first contact needle 21*a*, a second contact needle 21*b*, and a third contact needle 21*c* of the plurality of contact needles 21*a*-21*f* are arranged such that they lie on a circle 41. The circle 41 is shown in dotted auxiliary lines, as this is only serves to describe the type of arrangement.

Figure 17:
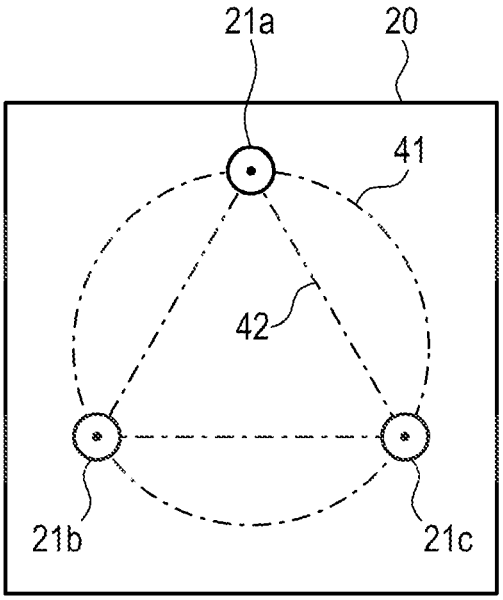
FIG. 17 shows a first exemplary illustration of an arrangement of contact needles on a current collector.

In the example shown in FIG. 17, the current collector 20 comprises three contact needles 21*a-c*, wherein the first, the second and the third contact needle 21*a*-21*c* of the current collector 20 are arranged such that they form a triangle 42, in particular an acute-angled triangle, in particular an isosceles triangle, and in particular an equilateral triangle.

Figure 21:
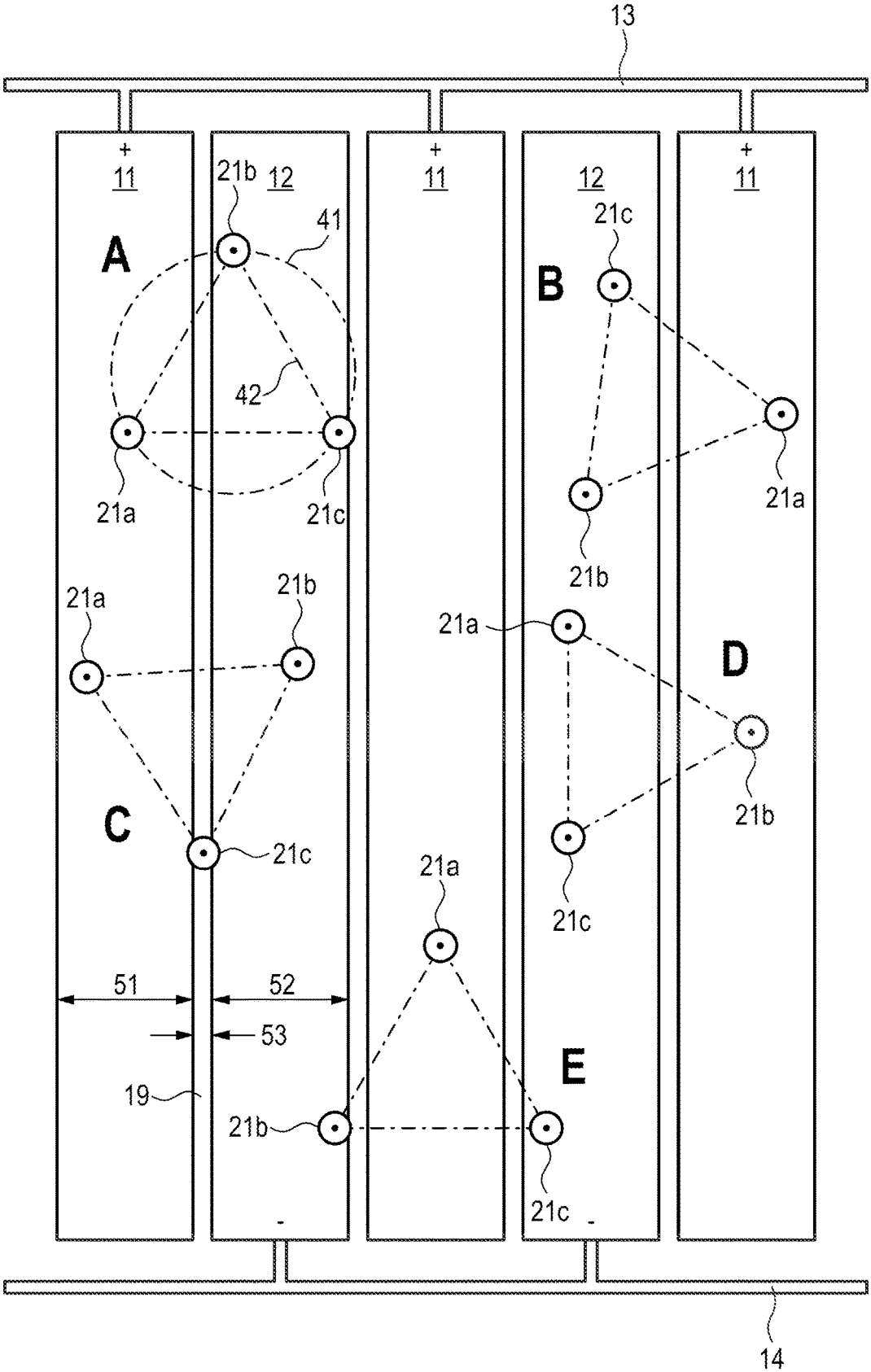
FIG. 21 shows an illustration of arrangements of contact needles on a current-carrying member in different positions and rotations

FIG. 21 shows an illustration of the current collector shown in FIG. 17 or respectively its contact needle arrangement in different positions and rotations A to F. In the background, the first electrical conductor tracks 11 and second electrical conductor tracks 12 of the wall member 10 are shown. The current collector 20 (more precisely its contact needle arrangement) is adapted to be attached to the wall member such that at least one of the contact needles 21*a* contacts one of the first electrical conductors 11 and at least one other of the contact needles 21*b*, 21*c* contacts one of the second electrical conductors 12. As can be seen from FIG. 21, even in a plurality of different rotation states, at least one of the contact needles can always be in contact with one of the first electrical conductor tracks 11, here the positive pole, and at least one of the contact needles can be in contact with one of the second electrical conductor tracks 12, here the negative pole. This applies even if, as shown in position C, one of the contact needles 21*c* lies in an insulation gap 19 between the tracks 11, 12.

Hereby, a diameter of the circle 41 (see FIG. 17), on which the first contact needle, the second contact needle and the third contact needle are arranged, can be smaller than or equal to the sum of a width 51 of one of the first conductor tracks 11 and a width 52 of one of the second conductor tracks 12 and optionally a width 53 of the insulation gap 19 between them. As shown in FIG. 21 at position E, two contact needles 21*b*, 21*c* can also lie on different conductor tracks 12 of the same polarity, whereby a third of the contact needles 21*a* lies on a conductor track 11 of the other polarity. Optionally, the contact needles 21*a-c* can be arranged such that a distance between the first contact needle 21*a* and a straight line through the second contact needle 21*b* and the third contact needle 21*c* is greater than a width 51, 52 of one of the electrical tracks 11, 12.

The following table shows exemplary combinations of conductive track widths and circle diameters 41, assuming an insulation gap with a width of 1 mm and a contact area of 0.5 mm. The first and second conductive tracks 11, 12 can have the same track width.

| Electrical conductor track width in mm | Circle diameter d in mm |
|---|---|
| 9 | 16-17 |
| 10 | 17-19 |
| 11 | 18-21 |
| 14 | 22-27 |
| 15 | 24-29 |
| 19 | 29-37 |
| 20 | 30-39 |

Figure 22:
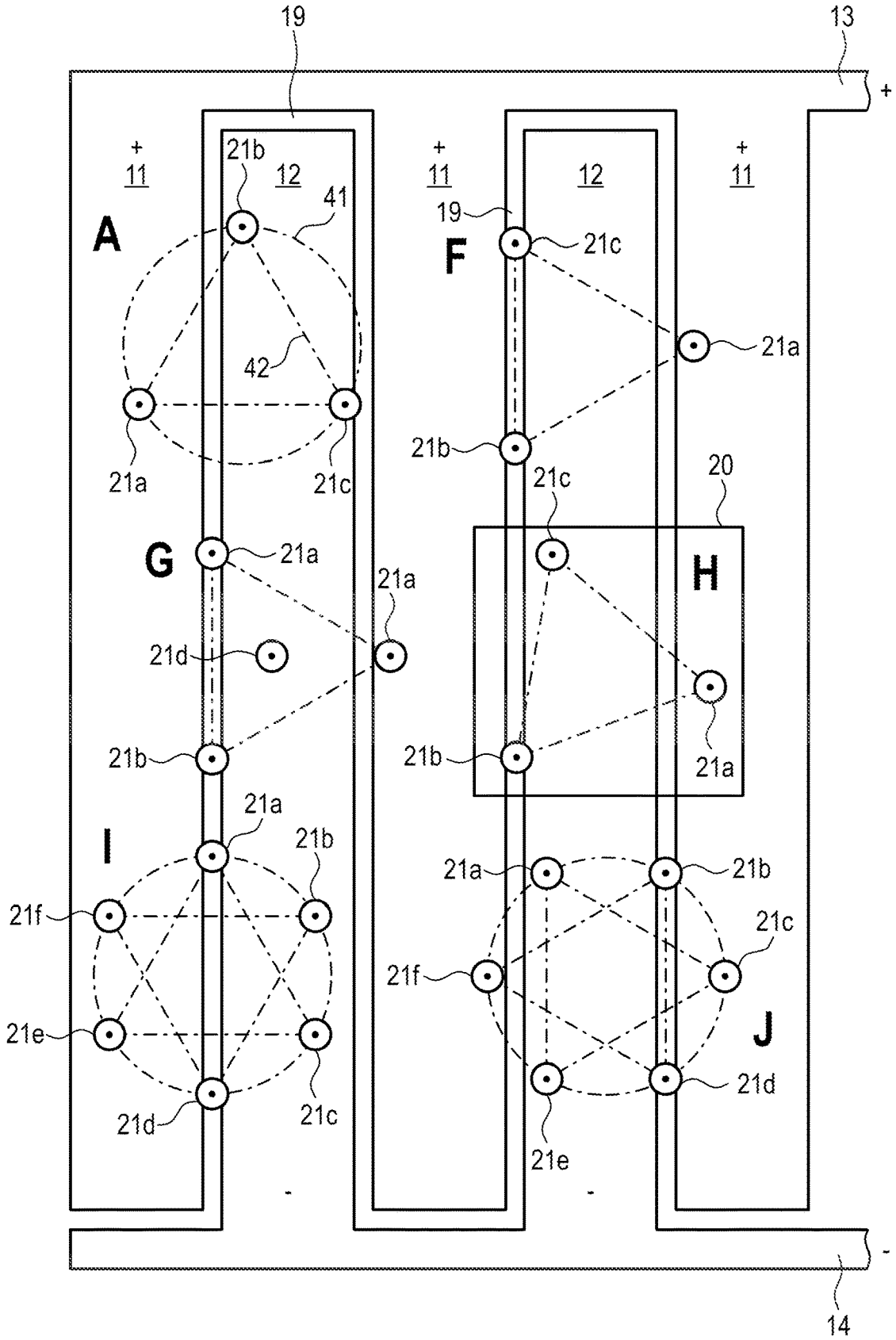
FIG. 22 shows a further illustration of different arrangements of contact needles on a current-carrying wall member in different positions and rotations

FIG. 22 shows another illustration of different arrangements of contact needles on a current-carrying wall member in different positions and rotations. However, in a particularly unfavorable case, as shown in FIG. 22 position E, for example, the second contact needle 21*b* and the third contact needle 21*c* can fall into the insulation gap 19 between the tracks 11, 12. In this special case, a power supply would not be possible without any further action. A first possible solution is to combine a first and a second current collector with different rotational orientations of the contact needles 21*a*-21*c*, for example with the orientations shown in FIG. 22 position A and position B. However, this would require a not negligible amount of material.

Figure 18:
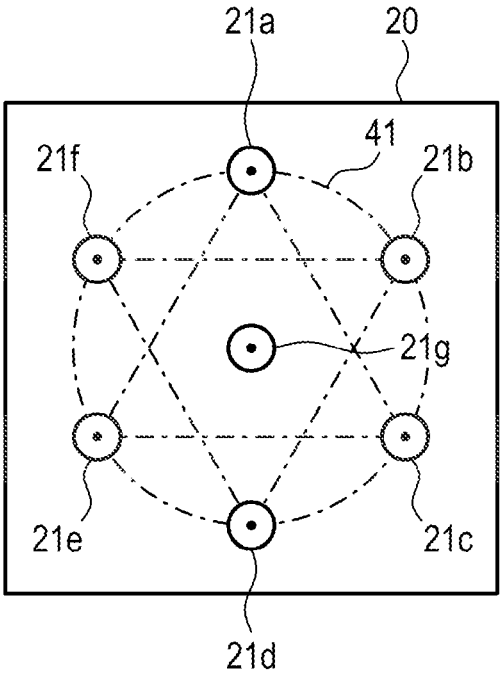
FIG. 18 shows a second exemplary illustration of an arrangement of contact needles on a current collector.
Figure 19:
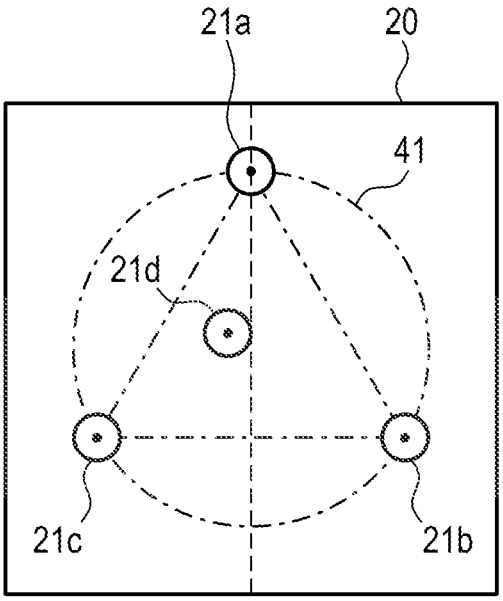
FIG. 19 shows a third exemplary illustration of an arrangement of contact needles on a current collector.
Figure 20:
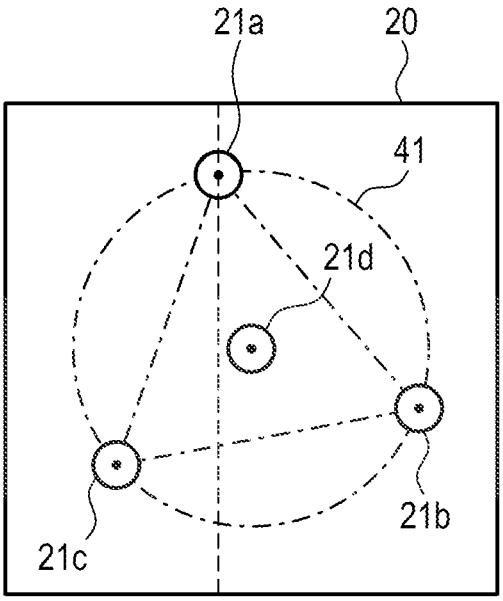
FIG. 20 shows a fourth exemplary illustration of an arrangement of contact needles on a current collector.

FIG. 22 positions G to J show further exemplary remedies. As shown in FIGS. 19 and 20 and FIG. 22 position G, the current collector 10 can optionally be provided with a fourth contact needle 21*d*. The fourth or further contact needle 21*d* can be arranged within the circle 41, on which the first, second and third contact needle 21*a-c* are located. It shall be understood that such a further contact needle inside the circle can also be provided in combination with further contact needles, as for example shown in FIG. 18. In FIG. 18 such an optional further or second fourth contact needle is denoted 21*g*. Thereby the flexibility regarding free positioning and rotation of the current collector relative to the wall member can be further improved. In the examples shown in FIG. 20 and FIG. 22 G, the fourth contact needle can be arranged in a center of circle 41 and/or in a center of gravity of triangle 42 (these points coincide for an equilateral triangle).

Optionally, the fourth contact needle 21*d* can be arranged spaced apart decentered from a center of the circle 41, as shown in FIG. 19. This has the advantage of reducing the probability that, for example, the contact needles 21*a* and 21*d* will lie in a straight line 43, which is parallel to a horizontal or vertical axis of the current collector 20. The inventors recognized that the current collectors 20 are often aligned horizontally or vertically. Against this background, it can be advantageous to arrange the positioning of the contact needles turned with respect to a horizontal or vertical axis of the current collector 20, as shown in FIG. 20 and FIG. 22 position H. This can also provide the advantage of reducing the probability that, for example, contact needles 21*a* and 21*d* are located on a straight line 43 parallel to a horizontal or vertical axis of the current collector 20. The use of a fourth contact needle 21*d* is optional. In particular, exactly three contact needles can be provided in this case, so that the costs and the manufacturing effort can be further reduced.

In a further exemplary embodiment the current collector 20 may also comprise a fourth contact needle 21*d*, a fifth contact needle 21*e* and a sixth contact needle 21*f*. The six contact needles 21*a-f* can be arranged as a hexagon, especially as an equilateral hexagon or star. As shown in the examples in FIG. 22 position I and J, in this case, even if two contact needles 21*a* and 21*d*, as shown in FIG. 22 position I, or 21*b* and 21*d*, as shown in FIG. 22 position J, fall into the insulation gap 19, an electrical connection can still be established with one of the first electrical conductor tracks 11 and one of the second electrical conductor tracks 12. Another advantage of this embodiment can be that when the current collector 20 is attached to the wall member 10, at least two contact needles 21*e*, 21*f* contact one or more of the first electrical conductor tracks 11 and at least two of the contact needles 21*b*, 21*c* contact one or more of the second electrical conductor tracks 12. This may allow higher current flows and thus higher power of an electrical device 5 connected to the current collector 20.

FIG. 23 shows an illustration of a current collector 20 with an arrangement of three contact needles 21*a*-21*c* in connection with a rectifier 22. FIG. 24 shows a corresponding representation of a current collector 20 with an arrangement of four contact needles 21*a*-21*d* in connection with a rectifier 22. In the shown examples, a diode bridge rectifier is shown, but other types of rectifiers can be used. An advantage of this solution is a simple, low-cost design, which is also easily scalable for a larger number of contact needles 21*a-f*. An output voltage of defined polarity is provided at outputs 24*a*, 24*b*, which can be fed to an electrical load 5.

FIG. 25 A to C show a top view (C), as well as a first and a second side view (A,B) of a specific exemplary embodiment of a current collector 20 for an electrical device. FIG. 26 shows a perspective view of this current collector 20. Such a current collector can also be called a needle connector. Here the contact needles 21*a*-21*d* can be arranged on a lower side or first side of the housing and the current interfaces 24*a*, 24*b* can be arranged on an upper side or second (opposite) side of the housing. For example, the rectifier circuit 20 shown in FIG. 24 may be integrated into the current collector 20. Hence a compact component can be provided that can be handles easily.

In the shown example, the current collector comprises four contact needles, which may for example be arranged similar to the illustration shown in FIG. 20. However, other arrangements or numbers of contact needles may be provided. In particular, the current collector 20 may be adapted such that, with horizontal or vertical alignment of the current collector, a straight line through the first and second contact needles 21*a*, 21*b* intersects a horizontal or vertical axis of the current collector at an acute angle, in particular at an angle not exceeding 30°, in particular at an angle not exceeding 15°, in particular at an angle not exceeding 5%.

FIG. 27 shows a perspective view of a current collector 20 with a magnet holder 30. The magnet holder 30 may comprise one or more magnets 32 adapted to attach the magnet holder 30 and thus the current collector 20 to a wall member 10 as shown in FIG. 1. The magnet holder can have a receptacle 33 for the current collector 20, here in the form of a groove 33 provided on the magnet holder, which interacts with a corresponding tongue 27 of the current collector 20.

Optionally, the current collector 20 (especially in combination with the holder 30) can be adapted such that the contact needles 21*a-d* can be moved between a contact position, in which the contact needles can contact the electrical conductor tracks of the wall member, and a non-contact position, in which the contact needles are at a distance from the conductor tracks, when the current collector is placed on the current-carrying wall member. For this purpose, the current collector 20 may comprise a spring element 28, for example as shown in FIG. 25B and FIG. 26. The magnetic holder 30 may optionally further comprise a slot 33 for an electrical device. In this case, the electrical device can be adapted to contact the output pins or output contacts 24*a*, 24*b* for power supply in an inserted position. Optionally, the current collector 20 in combination with the holder 30 can be adapted to be moved from the non-contact position to the contact position by inserting an electrical device into the plug-in unit or groove 33.

Figure 28:
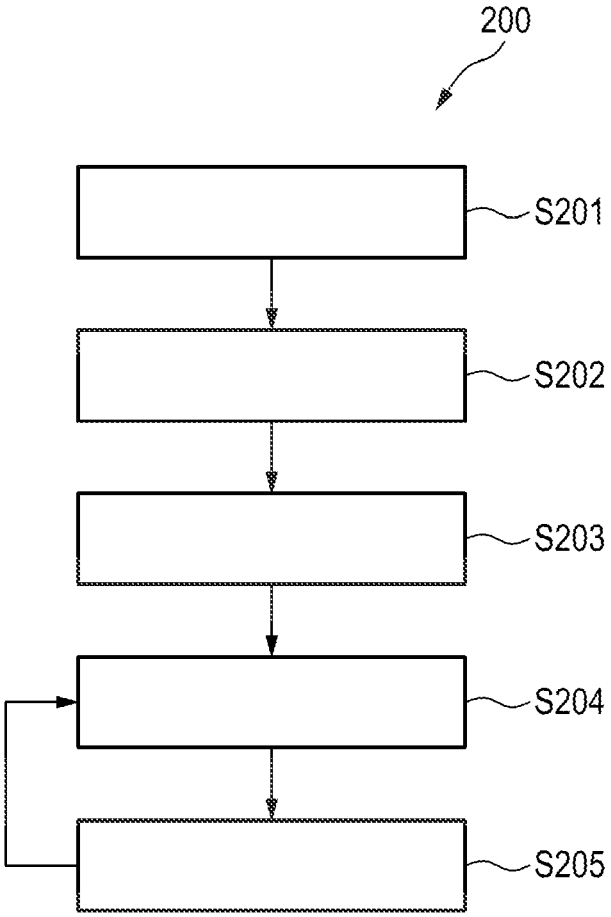
FIG. 28 shows a flowchart of a method

FIG. 28 shows a flow chart of a method 200, in particular for a presentation, sales or exhibition stand (100) and/or for store fitting. In a first step S201, a current-carrying wall member as described in the present disclosure is provided. In a second step S202, a current collector as described in the context of the present disclosure is provided. In a third step S203, the current collector is attached to the current-carrying wall member in such a way that a first of the contact needles contacts one of the first electrical conductor tracks and at least one other of the contact needles contacts one of the second electrical conductor tracks.

In an optional fourth step S204, a check of the position and rotation of the current collector (or of an electrical device comprising the current collector or connected to the current collector) can be performed. In an optional fifth step S205 a correction of the position and/or rotation of the current collector can be made. Steps S204 and S205 can optionally be repeated iteratively until a desired position and rotational alignment is reached. This can further improve the flexibility in the placement or design of such a presentation system. In particular, it is not necessary to define a position and angular alignment of the electrical consumers in advance, as they can be flexibly adjusted.

It shall be understood that the embodiments described herein as examples can also be used in modified form, for example with a different number of contact needles, different dimensions, different distances between contact needles and surfaces and/or modifications of the geometric arrangement, within the scope of the attached claims respectively.

It shall be understood that the shown strictly vertical or horizontal arrangement of the electrical conductor tracks, as shown in FIG. 2, is to be understood as an example, so that they can also be provided thinner, thicker, diagonally or in some other way such as e.g. circular or meandering on the carrier element 15. For the operation of the electrical device 5 the current collector can interact with the electrical conductor tracks arranged on the carrier element in such a way that at least a first contact needle can come into electrical contact with one of the first conductor tracks and a second contact needle with one of the second conductor tracks. For the power supply, in particular low-voltage systems can be used, which work with 12/24 V and can therefore be used without danger. However, by using special insulators which are applied as varnish, foil and/or other materials, it is also conceivable to use higher-voltage systems, i.e. systems operating at higher voltage, if necessary. Thanks to the e.g. needle-like design of the contacting needles, they can be moved frequently without damaging the cover. In general, the conductors 11, 12 usually carry low voltage, for example 12 or 24 V, so that the risk of injury when handling the proposed wall member 10 or the current collector 20 or an electrical device 5 connected to it can be almost completely excluded. The application of the conductor tracks 11, 12 on the carrier plate 15 can be done for example by spraying, gluing or welding. In particular, conductive lacquers can also be used for the conductor paths 11, 12 which are sprayed/printed (e.g. by screen printing) onto the carrier plate 15.

It is also possible that the wall members 10 may not only be made flat, but can also be curved or arched. Modern magnets 6 enable magnetic forces of considerably more than 80 kg, so that even large electrical devices 5 or electrical devices 5 arranged in special presentation elements, such as shelves 11 (see FIG. 1), can be easily mounted to the respective wall members 10.

The wall member 10 can also be designed flexibly, in particular it can be rolled up or down, so that it can for example be used as wallpaper or floor covering. The wall member 10 can be constructed as a sandwich material, which comprises the current-carrying conductors 11, 12 and can be used or mounted as wallpaper/carpet (rolled material) or panel material.

The sandwich construction can be done as follows: The cover 18 (surface material) is configured as a thin, penetrable, flexible material, behind this the conductor tracks 11, 12 are arranged on an insulating material, behind this there is the carrier material 15 made of plastic and/or of magnetic or magnetizable material, such as steel.

The current collector 20 and/or the electrical consumer 5 can also be intelligent or programmable. Data can be transmitted by modulating a signal on one or both of the electrical conductor tracks 11, 12 by means of so-called power line communication (PLC) or by wireless communication or optically. For example, different current collectors 20 and/or electrical devices 5 can be selectively controlled. For example, switching/dimming/controlling of individual devices 5 is possible. Furthermore, a bus system can also be provided in which the electrical conductors 11, 12, the current collectors 20 and/or the electrical devices 5 represent a part of the bus system and with which individual devices 5 can be individually addressed/controlled.

Optionally, a wall member can also be adapted to be applied under a wall covering, such as fiberglass wallpaper, and used for example in the field of smart home or in a museum. The current collectors can be used to supply electrical devices, such as lighting equipment for pictures or other exhibits or monitors explaining the exhibits, with electrical energy.

Likewise, the proposed system can be used in an office or a private home, where it can then be placed for example under a surface of textile, foil or wood veneer or other wall surface materials. By means of the current collectors it is possible to flexibly supply electrical devices at different positions and especially at different angles of rotation with electrical energy, without having to provide a multitude of possibly ugly power outlets. In particular when using a low-voltage system, the safety for children or other persons can be improved while at the same time providing increased flexibility.

What is claimed is:

1. A system, configured for a presentation, sales or exhibition stand and/or for store fitting, the system comprising:

a current-carrying wall member; and a current collector for an electrical device, which is configured to be mounted on the wall member;

wherein the wall member comprises a carrier plate having a front side and a back side;

wherein the wall member comprises first electrical conductor tracks of a first polarity and second electrical conductor tracks of a second polarity, wherein the first and second electrical conductor tracks are arranged alternately at least in sections;

wherein the first electrical conductor tracks and the second electrical conductor racks are arranged on the front side of the carrier plate;

wherein the current collector comprises a plurality of at least two contact needles, wherein the current collector is adapted to be attached to the wall member such that at least one of the contact needles contacts one of the first electrical conductor tracks and at least one other of the contact needles contacts one of the second electrical conductor tracks; and wherein the wall member comprises a first electrical terminal contact and a second electrical terminal contact, wherein the first electrical terminal contact is electrically conductively coupled to the first electrical conductor tracks, wherein the second electrical terminal contact is electrically conductively coupled to the second electrical conductor tracks, and wherein the first electrical terminal contact and the second electrical terminal contact are arranged on the back side of the carrier plate;

wherein the first electrical conductor tracks and the second electrical conductor tracks form an engaging comb structures;

wherein the first electrical conductor tracks form a first comb and the second electrical conductor tracks form a second comb, wherein for at least one of the two combs prongs of the comb structure are arranged on the front side of the carrier plate and a web of the comb structure connecting the prong is arranged on the back side of the carrier plate.

2. The system according to claim 1, wherein an extension of the first electrical conductor tracks is guided around an edge of the carrier plate from the front side to the back side of the carrier plate and is electrically conductively coupled to the first electrical terminal contact; and wherein an extension of the second electrical conductor tracks is guided around an edge of the carrier plate from the front side to the back side of the carrier plate and is electrically conductively coupled to the second electrical terminal contact.

3. The system according to claim 1, wherein the electrical conductive tracks on the front side and the electrical terminal contacts on the back side comprise a common electrically conductive layer; and wherein the electrically conductive layer is guided around an edge of the carrier plate from the front side of the carrier plate to the back side of the carrier plate.

4. The system according to claim 3, wherein the electrical conductive tracks on the front side and the electrical terminal contacts on the back side comprise a common electrically conductive foil which is applied to the carrier plate.

5. The system according to claim 1, wherein the first and the second electrical terminal contacts are arranged rotationally symmetrically on the back side of the carrier plate.

6. The system according to claim 5, wherein the first and second electrical terminal contacts are arranged at diagonally opposite corners on the back side of the carrier plate.

7. The system according to claim 1, wherein the first and second electrical terminal contacts are arranged mirror-symmetrically on the back side of the carrier plate.

8. The system according to claim 1, wherein the wall member further comprises a third electrical terminal contact and a fourth electrical terminal contact, wherein the third electrical terminal contact is electrically conductively coupled to the first electrical conductor tracks, wherein the fourth electrical terminal contact is electrically conductively coupled to the second electrical conductor tracks, and wherein the third electrical terminal contact and the fourth electrical terminal contact are arranged on the back side of the carrier plate.

9. The system according to claim 1, wherein the wall member is square.

10. The system according to claim 1, wherein the first electrical terminal contact is arranged in a first edge region on the back side of the carrier plate and the second electrical terminal contact is arranged in a second opposite edge region on the back side of the carrier plate.

11. The system according to claim 1, wherein the first electrical terminal contact extends along a first edge of the back side of the carrier plate; and wherein the second electrical terminal contact extends along a second, opposite edge of the back side of the carrier plate.

12. The system according to claim 1, wherein the first and second electrical terminal contacts on the back side are coupled by electrical connections through the carrier plate to the respective corresponding electrical conductor track on the front side.

13. The system according to claim 1, further comprising a cover covering the front side of the carrier plate.

14. The system according to claim 1, wherein the wall member and the current collector are adapted such that the current collector is magnetically attachable to the wall member.

15. The system according to claim 1, wherein the system comprises a plurality of at least one of at least two, at least four, and/or at least nine of the wall members, and wherein the system further comprises an electrode arrangement for supplying power to the wall elements via the first and second electrical terminal contacts on the back side.

16. The system according to claim 15, wherein the electrode arrangement comprises a first group and a second group of electrodes, said first group of electrodes being adapted and arranged to connect said first electrical terminal contacts of said respective wall elements to a first polarity;

said second group of electrodes being adapted and arranged to connect said second electrical terminal contacts of the respective wall elements to a second polarity.

17. The system according to claim 16, wherein the electrodes of the first group and the electrodes of the second group are arranged in different rows and/or columns.

18. The system according to claim 16, wherein the electrodes of the first group and the electrodes of the second group are arranged in a checkerboard pattern.

19. The system according to claim 15, wherein the electrode arrangement is further adapted such that the wall elements are magnetically attachable to the electrode arrangement.

20. The system according to claim 15, wherein the electrode arrangement is further adapted such that the wall elements are magnetically attachable to the electrode arrangement, and wherein the electrode arrangement comprises electrically conducting magnets.

21. The system according to claim 1, further comprising a wall member without front side conductor tracks.

22. The system according to claim 21, wherein the wall member without front side conductor tracks has a backside electrical insulation.

23. Wall member in a system according to claim 1, the system being a system for a presentation, sales or exhibition stand and/or for store fitting, the system comprising a current-carrying wall member and a current collector for an electrical device, which is configured to be mounted on the wall member;

wherein the wall member comprises a carrier plate having a front side and a back side;

wherein the wall member comprises first electrical conductor tracks of a first polarity and second electrical conductor tracks of a second polarity, wherein the first and second electrical conductor tracks are arranged alternately at least in sections; wherein the first electrical conductor tracks and the second electrical conductor tracks are arranged on the front side of the carrier plate;

wherein the current collector comprises a plurality of at least two contact needles, wherein the wall member is adapted such that that the current collector is attachable to the wall member such that at least one of the contact needles contacts one of the first electrical conductor tracks and at least one other of the contact needles contacts one of the second electrical conductor tracks; and wherein the wall member comprises a first electrical terminal contact and a second electrical terminal contact, wherein the first electrical terminal contact is electrically conductively coupled to the first electrical conductor tracks, wherein the second electrical terminal contact is electrically conductively coupled to the second electrical conductor tracks, and wherein the first electrical terminal contact and the second electrical terminal contact are arranged on the back side of the carrier plate;

wherein the first electrical conductor tracks and the second electrical conductor tracks form an engaging comb structure;

wherein the first electrical conductor tracks form a first comb and the second electrical conductor tracks form a second comb, wherein for at least one of the two combs the prongs of the comb structures are arranged on the front side of the carrier plate and a web of the comb structure connecting the prongs is arranged on the back side of the carrier plate.

24. A method to manufacture a wall member for a system that includes:

a current-carrying wall member; and a current collector for an electrical device, which is configured to be mounted on the member;

wherein the wall member comprises a carrier plate having a front side and a back side;

wherein the wall member comprises first electrical conductor tracks of a first polarity and second electrical conductor tracks of a second polarity, wherein the first and second electrical conductor tracks are arranged alternately at least in sections; wherein the first electrical conductor tracks and the second electrical conductor tracks are arranged on the front side of the carrier plate;

wherein the current collector comprises a plurality of at least two contact needles, wherein the current collector is adapted to be attached to the wall member such that at least one of the contact needles contacts one of the first electrical conductor tracks and at least one other of the contact needles contacts one of the second electrical conductor tracks; and wherein the wall member comprises a first electrical terminal contact and a second electrical terminal contact, wherein the first electrical terminal contact is electrically conductively coupled to the first electrical conductor tracks, wherein the second electrical terminal contact is electrically conductively coupled to the second electrical conductor tracks, and wherein the first electrical terminal contact and the second electrical terminal contact are arranged on the back side of the carrier plate;

wherein the first electrical conductor tracks and the second electrical conductor tracks form an engaging comb structure;

wherein the first electrical conductor tracks form a first comb and the second electrical conductor tracks form a second comb, wherein for at least one of the two combs the prongs of the comb structure are arranged on the front side of the carrier plate and a web of the comb structure connecting the prongs is arranged on the back side of the carrier plate, the method comprising providing the carrier plate, wherein the carrier plate has the front side and the back side;

applying first electrical conductor tracks of the first polarity and second electrical conductor tracks of the second polarity;

applying the first electrical terminal contact and the second electrical terminal contact on the back side of the carrier plate.

* * * * *